US006653061B2

(12) United States Patent
Rieger et al.

(10) Patent No.: US 6,653,061 B2
(45) **Date of Patent: *Nov. 25, 2003**

(54) PHOTOGRAPHIC LABEL FOR REPRODUCTION OF FINE PRINT

(75) Inventors: John B. Rieger, Webster, NY (US); Robert P. Bourdelais, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 56 days.

This patent is subject to a terminal disclaimer.

(21) Appl. No.: 10/027,512

(22) Filed: Dec. 21, 2001

(65) Prior Publication Data

US 2003/0170574 A1 Sep. 11, 2003

(51) Int. Cl.[7] ..... G03C 1/46

(52) U.S. Cl. ..... 430/505; 430/510; 430/263; 430/256; 430/259; 430/262; 430/496; 430/523; 430/531; 430/533; 430/536; 430/538; 430/604; 430/605; 430/553; 430/557; 430/558

(58) Field of Search ..... 430/505, 510, 430/263, 256, 259, 262, 496, 523, 531, 533, 536, 538, 604, 605, 553, 558, 557

(56) References Cited

U.S. PATENT DOCUMENTS

| | | | | |
|---|---|---|---|---|
| 4,558,002 | A | | 12/1985 | Aotsuka et al. |
| 5,418,118 | A | | 5/1995 | Edwards et al. |
| 5,512,103 | A | | 4/1996 | Edwards et al. |
| 5,866,282 | A | | 2/1999 | Bourdelais et al. |
| 5,985,075 | A | | 11/1999 | Freedman |
| 6,045,965 | A | | 4/2000 | Cournoyer et al. |
| 6,090,461 | A | | 7/2000 | Frank et al. |
| 6,146,744 | A | | 11/2000 | Freedman |
| 6,180,328 | B1 | | 1/2001 | Edwards et al. |
| 6,197,489 | B1 | | 3/2001 | Edwards et al. |
| 6,277,547 | B1 | | 8/2001 | Bourdelais et al. |
| 6,296,995 | B1 | | 10/2001 | Camp et al. |
| 6,368,758 | B1 | * | 4/2002 | Camp et al. ..... 430/505 |
| 6,436,604 | B1 | * | 8/2002 | Bourdelais et al. ..... 430/533 |
| 6,514,646 | B1 | * | 2/2003 | Nair et al. ..... 430/536 |
| 6,531,258 | B1 | * | 3/2003 | Rieger et al. ..... 430/263 |
| 6,544,714 | B1 | * | 4/2003 | Bourdelais et al. ..... 430/263 |

FOREIGN PATENT DOCUMENTS

| | | |
|---|---|---|
| EP | 0 952 484 | 10/1999 |
| EP | 0 991 048 | 4/2000 |
| EP | 1 079 272 | 2/2001 |
| EP | 1 089 127 | 4/2001 |

* cited by examiner

*Primary Examiner*—Geraldine Letscher
(74) *Attorney, Agent, or Firm*—Paul A. Leipold

(57) ABSTRACT

The invention relates to a photographic label comprising a pragmatic polymer sheet, at least one layer comprising at least one image forming layer comprising photosensitive silver halide grains and dye forming coupler above said pragmatic polymer sheet, wherein said at least one image forming layer has an exposure time to obtain a usable Dmax of 1.5 of less than 0.01 seconds, wherein said at least one image forming layer is substantially free of image dye stabilizers, and wherein said polymer sheet has an L* of greater than 95.

31 Claims, No Drawings

PHOTOGRAPHIC LABEL FOR REPRODUCTION OF FINE PRINT

FIELD OF THE INVENTION

The invention relates to packaging materials. In a preferred form it relates to the use of silver halide pressure sensitive labels for the printing of text, graphics and images applied to packaging material.

BACKGROUND OF THE INVENTION

Pressure sensitive labels applied are applied to packages to build brand awareness, show the contents of the package, convey a quality message regarding the contents of a package and supply consumer information such as directions on product use, or an ingredient listing of the contents. Printing on the pressure sensitive label is typically applied directly to the package or a printed media, typically printed using gravure printing or flexography is applied to the package. The three types of information applied to a pressure sensitive label are text, graphic and images. Some packages only require one type of information while other packages require more than one type of information.

Prior art labels that are applied to packages consist of a face stock material, a pressure sensitive adhesive and a liner. The label substrate consisting of the face stock, pressure sensitive adhesive and liner are typically laminated and then printed utilizing a variety of non photographic printing methods. After printing, the labels are generally protected by an over laminate material or a protective coating. The completed label consisting of a protection layer, printed information, face stock, pressure sensitive adhesive and liner material is applied to packages utilizing high speed labeling equipment.

Flexography is an offset letterpress technique where the printing plates are made from rubber or photopolymers. The printing on pressure sensitive label is accomplished by the transfer of ink from the raised surface of the printing plate to the surface of the material being printed. The rotogravure method of printing uses a print cylinder with thousands of tiny cells which are below the surface of the printing cylinder. The ink is transferred from the cells when the print cylinder is brought into contact with the pressure sensitive label at the impression roll. Printing inks for flexography or rotogravure include solvent based inks, water based inks and radiation cured inks. While rotogravure and flexography printing does provide acceptable image quality, these two printing methods require expensive and time consuming preparation of print cylinders or printing plates which make printing jobs of less than 100,000 units expensive as the set up cost and the cost of the cylinders or printing plates is typically depreciated over the size of the print job.

Recently, digital printing has become a viable method for the printing of information on packages. The term digital printing refers to the electronic digital characters or electronic digital images that can be printed by an electronic output device capable of translating digital information. The two main digital printing technologies are ink jet and electrophotography.

The introduction of piezo impulse drop-on-demand (DOD) and thermal DOD ink jet printers in the early 1980's provided ink jet printing systems. These early printers were very slow, and the ink jet nozzles often clogged. In the 1990's Hewlett Packard introduced the first monochrome ink jet printer, and, shortly thereafter, the introduction of color, wide format ink jet printers enabled businesses to enter the graphic arts market. Today, a number of different ink jet technologies are being used for packaging, desktop, industrial, commercial, photographic, and textile applications.

In piezo technology, a piezo crystal is electrically simulated to create pressure waves, which eject ink from the ink chamber. The ink can be electrically charged and deflected in a potential field, allowing the different characters to be created. More recent developments have introduced DOD multiple jets that utilize conductive piezo ceramic material, which, when charged, increases the pressure in the channel and forces a drop of ink from the end of the nozzle. This allows for very small droplets of ink to form and be delivered at high speed at very high resolution, approximately 1,000 dpi printing.

Until recently, the use of color pigments in jet inks was uncommon. However, this is changing rapidly. Submicron pigments were developed in Japan for ink jet applications. Use of pigments allows for more temperature resistant inks required for thermal ink jet printers and laminations. Pigmented water-based jet inks are commercially available, and UV-curable jet inks are in development. Pigmented inks have greater lightfastness and water-resistance.

Digital ink jet printing has the potential to revolutionize the printing industry by making short-run, color print jobs more economical. However, the next commercial stage will require significant improvements in ink jet technology; the major hurdle remaining is to improve print speed. Part of this problem is the limitation of the amount of data the printer can handle rapidly. The more complex the design, the slower the printing process. Right now they are about 10 times slower than comparable digital electrostatic printers.

Electrophotography was invented in the 1930's by Chester Carlson. By the early 1970's, the development of an electrophotographic color copier was being investigated by many companies. The technology for producing color copiers was already in place, but the market was not. It would take many more years until customer demand for color copies would create the necessary incentive to develop suitable electrostatic color copiers. By the late 1970's a few companies were using fax machines that could scan a document, reduce the images to electronic signals, send them out over the telephone wire, and, using another fax machine, retrieve the electronic signals and print the original image using heat-sensitive papers to produce a printed copy.

In 1993 Indigo and Xeikon introduced commercial digital printing machines targeted on short-run markets that were dominated by sheet-fed lithographic printers. Elimination of intermediate steps associated with negatives and plates used in offset printing provides faster turnaround and better customer service. These digital presses share some of the characteristics of traditional xerography but use very specialized inks. Unlike inks for conventional photocopiers, these inks are made with very small particle size components in the range of 1 $\mu$m. Dry toners used in xerography are typically 8–10 $\mu$m in size.

In 1995 Indigo introduced the Omnius press designed for printing flexible packaging products. The Omnius uses a digital offset color process called One Shot Color that has six colors. A key improvement has been the use of a special white Electro ink for transparent substrates. The Omnius web-fed digital printing system allows printing of various substrates using an offset cylinder that transfers the color image to the substrate. In principle, this allows perfect register regardless of the substrate being printed; paper, film, and metal can be printed by this process. This digital printing system is based on an electrophotographic process where the electrostatic image is created on the surface of a photoconductor by first charging the photo-conductor by charge corona and exposing the photoconductive surface to a light source in image fashion.

The charged electrostatic latent image is then developed using ink containing an opposite charge to that on the image. This part of the process is similar to that of electrostatic toners associated with photo-copying machines. The latent charged electrostatic image formed on the photoconductor surface is developed by means of electrophoretic transfer of the liquid toner. This electrostatic toner image is then transferred to a hot blanket, which coalesces the toner and maintains it in a tacky state until it is transferred to the substrate, which cools the ink and produces a tack-free print.

Electro inks typically comprise mineral oil and volatile organic compounds below that of conventional offset printing inks. They are designed so that the thermoplastic resin will fuse at elevated temperatures. In the actual printing process, the resin coalesced, the inks are transferred to the substrate, and there is no need to heat the ink to dry it. The ink is deposited on the substrate essentially dry, although it becomes tack-free as it cools and reaches room temperature.

For several decades a magnetic digital technology called "magnetography" has been under development. This process involves creating electrical images on a magnetic cylinder and using magnetic toners as inks to create the image. The potential advantage of this technology lies in its high press speed. Tests have shown that speeds of 200 meters per minute. Although these magnetic digital printers are limited to black and white copy, developments of color magnetic inks would make this high-speed digital technology economically feasible. The key to its growth will be further development of the VHSM (very high speed magnetic) drum and the color magnetic inks.

Within the magnetic digital arena, a hybrid system called magnetolithography has been built and tested on narrow web and short-run applications developed by Nipson Printing Systems in Belfort, France. The technology appears to provide high resolution, and tests have been conducted using a silicon-based, high density, magnetographic head. Much more work is necessary in the ink development to bring this system to a competitive position relative to ink jet or electrophotography. However, the fact that it has high speed printing potential makes it an attractive alternate for packaging applications in which today's ink jet and electrophotography technologies are lagging.

Photographic materials have been known for use as prints for preserving memories for special events such as birthdays and vacations. They also have been utilized for large display materials utilized in advertising. These materials have been known as high quality products that are costly and somewhat delicate as they would be easily defaced by abrasion, water, or bending. Photographs are traditionally placed in frames, photo albums, and behind protective materials in view of their fragile and delicate nature, as well as their value. They are considered luxury items for the consumers to preserve a record of important events in their lives. They also have been considered as expensive display materials for advertising. In view of their status as luxury items, they have not been utilized in other areas of commerce.

PROBLEM TO BE SOLVED BY THE INVENTION

There is a need for pressure sensitive labels for application to packages that are high in quality and at the same time economical for low to moderate label order quantities.

SUMMARY OF THE INVENTION

It is an object of the invention to provide higher quality images to packaging materials.

It is a further object to provide silver halide media labels that have bright and sharp images using transparent dyes on a transparent, semi-transparent, or opaque label material.

It is another object to provide a continuous tone silver halide media label that is economical for smaller printing jobs less than 100,000 images.

These and other objects of the invention are accomplished by a photographic label comprising a pragmatic polymer sheet, at least one layer comprising at least one image forming layer comprising photosensitive silver halide grains and dye forming coupler above said pragmatic polymer sheet, wherein said at least one image forming layer has an exposure time to obtain a usable Dmax of 1.5 of less than 0.01 seconds, wherein said at least one image forming layer is substantially free of dye stabilizers, and wherein said polymer sheet has an L* of greater than 95.

ADVANTAGEOUS EFFECT OF THE INVENTION

The invention provides improved image quality for packaging materials. The invention enables a printing method that can economically print text, graphic and images using negative working optical systems or optical digital printing systems for the formation of a silver halide pressure sensitive label for packaging.

DETAILED DESCRIPTION OF THE INVENTION

The invention has numerous advantages over prior practices in the art. Recently there has been a trend in the marketing of mass consumer items to try to localize the marketing to separately approach smaller groups. These groups may be regional, ethnic, gender, age, or special interest differentiated. In order to approach these different groups, there is a need to provide packaging that is specifically directed to these groups. As discussed above, the traditional packaging materials are generally suited for very long runs of material and to form shorter runs or to provide rapid changes in packaging is impossible or very expensive. We have found silver halide based photographic materials that are suitable for packaging uses. Further, recently there has become available rapid photo processing apparatus suitable for short runs of material. There is also available silver halide processing apparatus that is capable of high speed relatively long continuous runs of material. The combination of low cost packaging suitable photographic material with the processing apparatus available for rapid short and long runs of material has resulted in the opportunity for silver halide material to be utilized in packaging materials. Silver halide materials that have properties such as flexibility, low cost, and the ability to flex and bend has resulted in materials satisfactory and suitable for packaging.

The utilization of the thin, flexible, and tough silver halide materials results in a packaging material having many superior properties. These materials are capable of having brighter, sharper, and higher color images that anything presently available in packaging. The packaging materials of the invention have a depth of image unsurpassed by existing packaging materials. The packaging materials of the invention may be further provided with a variety of packing materials that are suitable pressure sensitive labeling of packages such as shampoo bottles, perfume bottles and film boxes. The packaging materials of the invention while having the advantage of superior image are available on thin base materials which are low in cost while providing superior opacity and strength. The packaging materials of the invention as they may be imaged by flash optical exposure or digital printing have the ability to be formed in short runs and to be rapidly switched from one image to the next without delay.

The silver halide label materials of the invention allows packages to be rapidly designed and brought to market. For instance, significant events in sports or entertainment may be practically instantly brought to market as a digital image may be immediately flash exposed onto silver halide pressure sensitive labels and utilized within moments from the time of the event. This is in contrast to typical photogravure or flexographic imaging where lead times for pressure sensitive labels are typically several weeks. Rapid regional customization of images is possible.

The ability to rapidly change packaging also would find use in the need to provide regional labeling with different languages and marketing themes in different countries. Further, different countries have different legal labeling requirements as to content. For instance, alcoholic beverages such as wine and beer are subject to a wide variety of regional and national variations in labeling requirements. Wines manufactured in France may have long delays in shipping out of France due to the wait for national labeling in other countries. Photographic images also would be particularly desirable for a premium products such as fine wines, perfumes, and chocolates, as they would be of high quality and reflect the high quality of the product in the package.

The invention provides a printing method that is economically viable when printing short runs as the cost of printing plates or printing cylinders are avoided. The use of silver halide images applied to a package ensures the highest image quality currently available compared to the common but lower quality six color rotogravure printed images. Further, because the yellow, magenta, and cyan layers contain gelatin interlayers, the silver halide images appear to have depth compared to ink jet or electrophotographic images which appear flat and lifeless. Silver halide image layers have also been optimized to accurately replicate flesh tones, providing superior images of people compared to alternate prior art digital imaging technologies.

Silver halide image technology can simultaneously print text, graphics, and photographic quality images on the pressure sensitive label. Since the silver halide imaging layers of the invention are both optically and digitally compatible, text, graphics, and images can be printed using known digital printing equipment such as lasers and CRT printers. Because the silver halide system is digitally compatible, each package can contain different data enabling customization of individual packages without the extra expense of printing plates or cylinders. Further, printing digital files allows the files to be transported using electronic data transfer technology such as the internet thus reducing the cycle time to apply printing to a package. Silver halide imaging layers can be digitally exposed with a laser or CRT at speeds greater than 75 meters per minute allowing competitive printing speeds compared to current ink jet or electrophotographic printing engines.

Conventional silver halide print materials used for consumer snapshots, professional portraiture, and commercial signage are not customized for the packaging market. Expensive stabilization chemistry required to provide dye stability commiserate with "memories of a lifetime" is not required for conventional labeling applications, where shelf life is on the order of months to a few years, not decades or centuries. Thus, a media optimized for packaging would not require exotic dye stabilization chemistry.

Similarly, conventional silver halide print materials used for consumer snapshots, professional portraiture, and commercial signage require a high quantity of expensive ultraviolet absorbing dye to further improve dye stability. For most packaging applications, this dye would not be required and would add unneeded cost to the media. If required, the dye could be added via an environmental protection layer that would be applied to the media after it had been photo-processed.

A secondary advantage to removing image dye stabilizers and ultraviolet absorbing dyes is that less gelatin is required in the silver halide layers. Gelatin acts as a carrier for silver halide imaging elements and also serves to mechanically protect the image from physical damage during printing, processing, or customer use. As components are removed from-the media, such as image dye stabilizers and ultraviolet absorbing dyes, less gelatin is required to maintain acceptable physical toughness. Also, the gelatin layers of a silver halide material can lead to a curl problem during high speed labeling or to a curl problem of a label adhered to a some package materials in some environments. For example, silver halide media labels have been observed to have difficulties sticking to high density polyethylene bottles in high heat and low humidity conditions. This was due to a combination of marginal adherence to the bottle and the propensity of gelatin to shrink in these conditions. As gelatin is removed from the silver halide media, the amount of shrink force that is generated will be lowered, and the label will have improved chances of staying adhered to the bottle, all other things being equal.

A conventional silver halide print material for consumer snapshots and professional portraiture does not require the media to reproduce text or barcodes. Due to the inherent optical scattering characteristics of silver halide materials, special consideration must be given to the silver halide crystal architecture and the amount of silver halide required per unit area to image text and bar codes in such a fashion as to provide sharp, clear text that is readable by the human eye and by mechanical bar code readers. It has been discovered that acceptable bar code quality can be obtained by simultaneously optimizing the media for digital exposure, and by thinning the bar widths in the image file such that when the image is exposed through the light scattering silver halide crystals, the resultant bar code lines are back to nominal width and are readable by a bar code scanner to a "B" grade or higher. A 10% reduction in image file line width provided optimal performance with the media of this invention.

A conventional silver halide print material for consumer snapshots and professional portraiture does not require the media to reproduce trademark colors as required by commercial packaging applications. These colors are conventionally applied in a flexographic system by the use of a spot color in addition to CMYK process colors. The silver halide media of this invention would be compatible with the application of these spot colors if so desired in a post process application. It would also be desirable to extend the color gamut of a silver halide media label such that the secondary application of a spot color would not be required. Thus, the presence of additional imaging layers featuring dyes to extend the color gamut of the media is quite desirable. For example, a fourth imaging record that forms an orange colored dye would be quite advantageous in boosting color gamut when used in combination with the yellow, magenta, and cyan colored couplers of this invention.

The paper liner material is provided with high levels of moisture and salt to reduce static discharge during the application of the light sensitive silver halide imaging layers. Also the antistatic properties of the liner reduce static accumulation during high speed labeling.

The gelatin layers used as a matrix for the silver halide imaging system can be utilized to provide a curl toward the image reducing the number of packages that are mislabeled or not labeled because of a curl away from the image typical for ink printed labels. The image curl caused by the humidity contraction of the gelatin has been shown to improve labeling efficiency in some applications. These and other advantages will be apparent from the detailed description below.

The terms as used herein, "top", "upper", "emulsion side", and "face" mean the side or toward the side of a photographic packaging label bearing the imaging layers. The term environmental protection layer means the layer applied to the post processed imaging layers. The terms "face stock" and "substrate" mean the material to which the silver halide layers are applied. The terms "bottom", "lower side", "liner" and "back" mean the side or toward the side of the photographic label or photographic packaging material opposite from the side bearing the photosensitive imaging layers or developed image.

In order to provide a digital printing technology that can be applied to a package that is high in quality, can handle text, graphic and images, is economical for short run printing jobs and accurately reproduce flesh tones, silver halide imaging is preferred. The silver halide technology can be either black and white or color. The silver halide imaging layers are preferably exposed and developed prior to application to a package. The flexible substrate of the invention contains the necessary tensile strength properties and coefficient of friction properties to allow for efficient transport and application of the images in high speed labeling equipment. The substrate of the invention is formed by applying light sensitive silver halide imaging layers of a flexible label stock that contains a pressure sensitive adhesive. The imaging layers, face stock and pressure sensitive adhesive are supported and transported through labeling equipment using a tough liner material. Because the light sensitive silver halide imaging layers are vulnerable to environmental solvents such as water, coffee and hand oils, an environmental protection layer is preferably applied to the light sensitive silver halide imaging layers after image development.

The environmental protection layer may consist of suitable material that protects the image from environmental solvents, resists scratching and does not interfere with the image quality. The environmental protection layer is preferably applied to the photographic image after image development because the liquid processing chemistry required for image development must be able to efficiently penetrate the surface of the imaging layers to contact the silver halide and couplers utilizing typical silver halide imaging processes. The environmental protection layer would be generally impervious to developer chemistry. An environmental protection layer where transparent polymer particles are applied to the top most surface of the imaging layers in the presence of an electric field and fused to the top most layer causing the transparent polymer particles to form a continuous polymeric layer is preferred. An electrophotographic toner applied polymer is preferred as it is an effective way to provide a thin, protective environmental layer to the photographic label that has been shown to withstand environmental solvents and damage due to handling.

In another embodiment, the environmental protection layer is coatable from aqueous solution, which survives exposure and processing, and forms a continuous, water-impermeable protective layer in a post-process fusing step. The environmental protection layer is preferably formed by coating polymer beads or particles of 0.1 to 50 $\mu$m in average size together with a polymer latex binder on the emulsion side of a sensitized photographic product. Optionally, a small amount of water-soluble coating aids (viscosifiers, surfactants) can be included in the layer, as long as they leach out of the coating during processing. After exposure and processing, the product with image is treated in such a way as to cause fusing and coalescence of the coated polymer beads, by heat and/or pressure (fusing), solvent treatment, or other means so as to form the desired continuous, water impermeable protective layer.

Examples of suitable polymers from which the polymer particles used in environmental protection layer can be selected include poly(vinyl chloride), poly(vinylidene chloride), poly(vinyl chloride-co-vinylidene chloride), chlorinated polypropylene, poly(vinyl chloride-co-vinyl acetate), poly(vinyl chloride-co-vinyl acetate-co-maleic anhydride), ethyl cellulose, nitrocellulose, poly(acrylic acid) esters, linseed oil-modified alkyd resins, rosin-modified alkyd resins, phenol-modified alkyd resins, phenolic resins, polyesters, poly(vinyl butyral), polyisocyanate resins, polyurethanes, poly(vinyl acetate), polyamides, chroman resins, dammar gum, ketone resins, maleic acid resins, vinyl polymers, such as polystyrene and polyvinyltoluene or copolymer of vinyl polymers with methacrylates or acrylates, poly(tetrafluoroethylene-hexafluoropropylene), low-molecular weight polyethylene, phenol-modified pentaerythritol esters, poly(styrene-co-indene-co-acrylonitrile), poly(styrene-co-indene), poly(styrene-co-acrylonitrile), poly(styrene-co-butadiene), poly(stearyl methacrylate) blended with poly(methyl methacrylate), copolymers with siloxanes and polyalkenes. These polymers can be used either alone or in combination. In a preferred embodiment of the invention, the polymer comprises a polyester or poly (styrene-co-butyl acrylate). Preferred polyesters are based on ethoxylated and/or propoxylated bisphenol A and one or more of terephthalic acid, dodecenylsuccinic acid and fumaric acid as they form an acceptable environmental protection layer that generally survives the rigors of a packaging label.

To increase the abrasion resistance of the environmental protection layer, polymers which are cross-linked or branched can be used. For example, poly(styrene-co-indene-co-divinylbenzene), poly(styrene-co-acrylonitrile-co-divinylbenzene), or poly(styrene-co-butadiene-co-divinylbenzene) can be used.

The polymer particles for the environmental protection layer should be transparent, and are preferably colorless. But it is specifically contemplated that the polymer particle can have some color for the purposes of color correction, or for special effects, so long as the image is viewable through the overcoat. Thus, there can be incorporated into the polymer particle dye which will impart color. In addition, additives can be incorporated into the polymer particle which will give to the overcoat desired properties. For example, a UV absorber can be incorporated into the polymer particle to make the overcoat UV absorptive, thus protecting the image from UV induced fading or blue tint can be incorporated into the polymer particle to offset the native yellowness of the gelatin used in the silver halide imaging layers.

In addition to the polymer particles which form the environmental protection layer there can be combined with the polymer composition other particles which will modify the surface characteristics of the element. Such particle are solid and nonfusible at the conditions under which the polymer particles are fused, and include inorganic particles, like silica, and organic particles, like methylmethacrylate beads, which will not melt during the fusing step and which will impart surface roughness to the overcoat.

The surface characteristics of the environmental protection layer are in large part dependent upon the physical characteristics of the polymer which forms the toner and the presence or absence of solid, nonfusible particles. However, the surface characteristics of the overcoat also can be modified by the conditions under which the surface is fused. For example, the surface characteristics of the fusing member that is used to fuse the toner to form the continuous overcoat layer can be selected to impart a desired degree of smoothness, texture or pattern to the surface of the element. Thus, a highly smooth fusing member will give a glossy surface to the imaged element, a textured fusing member will give a matte or otherwise textured surface to the element, a patterned fusing member will apply a pattern to the surface of the element.

Suitable examples of the polymer latex binder include a latex copolymer of butyl acrylate, 2-acrylamido-2-methylpropanesulfonate, and acetoacetoxyethylmethacrylate. Other latex polymers which are useful include polymers having a 20 to 10,000 nm diameter and a Tg of less than 60° C. suspended in water as a colloidal suspension.

Examples of suitable coating aids for the environmental protection layer include any water soluble polymer or other material that imparts appreciable viscosity to the coating suspension, such as high MW polysaccharide derivatives (e.g. xanthan gum, guar gum, gum acacia, Keltrol (an anionic polysaccharide supplied by Merck and Co., Inc.) high MW polyvinyl alcohol, carboxymethylcellulose, hydroxyethylcellulose, polyacrylic acid and its salts, polyacrylamide, etc). Surfactants include any surface active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Ol in Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol OT), and alkylcarboxylate salts such as sodium decanoate.

The application of a ultraviolet polymerizable monomers and oligomers to the outermost layer of the developed silver halide imaging layers and subsequent radiation exposure to form a thin cross-linked protective layer is preferred. UV cure polymers are preferred as they can easily be applied to the outermost layer of the silver halide imaging layers and have been shown to provide an acceptable protective layer for the silver halide label material. Preferred UV cure polymers include aliphatic urethane, allyl methacrylate, ethylene glycol dimethacrylate, polyisocyanate and hydroxyethyl methacrylate. A preferred photoinitiator is benzil dimethyl ketal. The preferred intensity of radiation is between 0.1 and 1.5 milliwatt/cm$^2$. Below 0.05, insufficient cross linking occurs yielding a protective layer that does not offer sufficient protection for the labeling of packages.

The application of a pre-formed polymer layer to the outermost surface of the developed label silver halide image to form an environmental protection layer is most preferred. Application of a pre-formed sheet is preferred because pre-formed sheets are tough and durable easily withstanding the environmental solvents and handling forces applied to the silver halide imaged label. Application of the pre-formed polymer sheet is preferable carried out though lamination after image development. An adhesive is applied to either the photographic label or the pre-formed polymer sheet prior to a pressure nip that adheres the two surfaces and eliminates any trapped air that would degrade the quality of the image.

The pre-formed sheet preferably is an oriented polymer because of the strength and toughness developed in the orientation process. Preferred polymers for the flexible substrate include polyolefins, polyester and nylon. Preferred polyolefins include polypropylene, polyethylene, polymethylpentene, polystyrene, polybutylene, and mixtures thereof. Polyolefin copolymers, including copolymers of propylene and ethylene such as hexene, butene, and octene are also useful. Polypropylene is most preferred, as it is low in cost and has desirable strength and toughness properties required for a pressure sensitive label.

The application of a synthetic latex to the developed silver halide label image is another preferred environmental protection layer. A coating of synthetic latex has been shown to provide an acceptable environmental protection layer and can be coated in an aqueous solution eliminating exposure to solvents. The coating of latex has been shown to provide an acceptable environmental protection layer for the silver halide packaging label. Preferred synthetic latexes for the environmental protection layer are made by emulsion polymerization techniques from styrene butadiene copolymer, acrylate resins, and polyvinyl acetate. The preferred particles size for the synethetic latex ranges from 0.05 to 0.15 $\mu$m. The synthetic latex is applied to the outermost layer of the silver halide imaging layers by known coating methods that include rod coating, roll coating and hopper coating. The synthetic latexes must be dried after application and must dry transparent so as not to interfere with the quality of the silver halide image.

The face stock material, or the flexible substrate utilized in this invention on to which the light sensitive silver halide imaging layers are applied, must not interfere with the silver halide imaging layers. Further, the face stock material of this invention needs to optimize the performance of the silver halide imaging system. Suitable flexible substrates must also perform efficiently in a automated packaging equipment for the application of labels to various containers. A preferred flexible substrate is cellulose paper. A cellulose paper substrate is flexible, strong and low in cost compared to polymer substrates. Further, a cellulose paper substrate allows for a textured label surface that can be desirable in some packaging applications. The paper may be provided with coatings that will provide waterproofing to the paper as the photographic element of the invention must be processed in aqueous chemistry to develop the silver halide image. An example of a suitable coating is acrylic or polyethylene polymer.

Polymer substrates are another preferred face stock material because they are tear resistant, have excellent conformability, good chemical resistance and high in strength. Preferred polymer substrates include polyester, oriented polyolefin such as polyethylene and polypropylene, cast polyolefins such as polypropylene and polyethylene, polystyrene, acetate and vinyl. Polymers are preferred as they are strong and flexible and provide an excellent surface for the coating of silver halide imaging layers.

Biaxially oriented polyolefin sheets are preferred as they are low in cost, have excellent optical properties that optimize the silver halide system and can be applied to packages in high speed labeling equipment. Microvoided composite biaxially oriented sheets are most preferred because the voided layer provides opacity and lightness. Also, the voided layers of the microvoided biaxially oriented sheets have been shown to significantly reduce pressure sensitivity of the silver halide imaging layers. Microvoided biaxially oriented sheets are conveniently manufactured by coextrusion of the core and surface layers, followed by biaxial orientation, whereby voids are formed around void-initiating material contained in the core layer. Such composite sheets are disclosed in U.S. Pat. Nos. 4,377,616, 4,758,462; 4,632,869 and 5,866,282. The biaxially oriented polyolefin sheets also may be laminated to one or both sides of a paper sheet to form a label with greater stiffness if that is needed.

The flexible polymer face stock substrate may contain more than one layer. The skin layers of the flexible substrate can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

Voided biaxially oriented polyolefin sheets are a preferred flexible face stock substrate for the coating of light sensitive silver halide imaging layers. Voided films are preferred as they provide opacity, whiteness and image sharpness to the image. "Void" is used herein to mean devoid of added solid and liquid matter, although it is likely the "voids" contain gas. The void-initiating particles which remain in the finished packaging sheet core should be from 0.1 to 10 $\mu$m in diameter and preferably round in shape to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The photographic element of this invention generally has a glossy surface, that is, a surface that is sufficiently smooth to provide excellent reflection properties. An opalescent surface may be preferred because it provides a unique photographic appearance to a label that is perceptually preferred by consumers. The opalescent surface is achieved when the microvoids in the vertical direction are between 1 and 3 $\mu$m. By the vertical direction, it is meant the direction that is perpendicular to the plane of the imaging member. The thickness of the microvoids preferably is between 0.7 and 1.5 $\mu$m for best physical performance and opalescent properties. The preferred number of microvoids in the vertical direction is between 8 and 30. Less than 6 microvoids in the vertical direction do not create the desired opalescent surface. Greater than 35 microvoids in the vertical direction do not significantly improve the optical appearance of the opalescent surface.

The void-initiating material for the flexible face stock substrate may be selected from a variety of materials and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula Ar—C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2$=CH(O)COR, wherein R is an alkyl radical containing from 2 to 18 carbon atoms, acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above-described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate, and mixtures thereof.

Examples of typical monomers for making the cross-linked polymer void initiating particles include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly (methyl methacrylate). Most preferably, it is polystyrene, and the cross-linking agent is divinylbenzene.

Processes well known in the art yield nonuniformly sized void initiating particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, or calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

The total thickness of the topmost skin layer of the polymeric face stock substrate may be between 0.20 $\mu$m and 1.5 $\mu$m, preferably between 0.5 and 1.0 $\mu$m. Below 0.5 $\mu$m any inherent nonplanarity in the coextruded skin layer may result in unacceptable color variation. At skin thickness greater than 1.0 $\mu$m, there is a reduction in the photographic optical properties such as image resolution. At thickness greater than 1.0 $\mu$m, there is also a greater material volume to filter for contamination such as clumps or poor color pigment dispersion.

Addenda may be added to the top most skin layer of the flexible face stock substrate to change the color of the imaging element. For labeling use, a white substrate with a slight bluish tinge is preferred. The addition of the slight bluish tinge may be accomplished by any process which is known in the art including the machine blending of color concentrate prior to extrusion and the melt extrusion of blue colorants that have been preblended at the desired blend ratio. Colored pigments that can resist extrusion temperatures greater than 320° C. are preferred, as temperatures greater than 320° C. are necessary for coextrusion of the skin layer. Blue colorants used in this invention may be any colorant that does not have an adverse impact on the imaging element. Preferred blue colorants include Phthalocyanine blue pigments, Cromophtal blue pigments, Irgazin blue pigments, and Irgalite organic blue pigments. Optical brightener may also be added to the skin layer to absorb UV energy and emit light largely in the blue region. $TiO_2$ may also be added to the skin layer. While the addition of $TiO_2$ in the thin skin layer of this invention does not significantly contribute to the optical performance of the sheet, it can cause numerous manufacturing problems such as extrusion die lines and spots. The skin layer substantially free of $TiO_2$ is preferred. $TiO_2$ added to a layer between 0.20 and 1.5 $\mu$m does not substantially improve the optical properties of the support, will add cost to the design, and will cause objectionable pigments lines in the extrusion process.

Addenda may be added to the core matrix and/or to one or more skin layers to improve the optical properties of the flexible substrate. Titanium dioxide is preferred and is used in this invention to improve image sharpness or MTF, opacity, and whiteness. The $TiO_2$ used may be either anatase or rutile type. Further, both anatase and rutile $TiO_2$ may be blended to improve both whiteness and sharpness. Examples of $TiO_2$ that are acceptable for a photographic system are DuPont Chemical Co. R101 rutile $TiO_2$ and DuPont Chemical Co. R104 rutile $TiO_2$. Other pigments known in the art to improve photographic optical responses may also be used in this invention. Examples of other pigments known in the art to improve whiteness are talc, kaolin, $CaCO_3$, $BASO_4$, ZnO, $TiO_2$, ZnS, and $MgCO_3$. The preferred $TiO_2$ type is anatase, as anatase $TiO_2$ has been found to optimize image whiteness and sharpness with a voided layer.

Addenda may be added to the flexible face stock substrate of this invention so that when the biaxially oriented sheet is viewed from a surface, the imaging element emits light in the visible spectrum when exposed to ultraviolet radiation. Emission of light in the visible spectrum allows for the support to have a desired background color in the presence of ultraviolet energy. This is particularly useful when images are viewed outside as sunlight contains ultraviolet energy and may be used to optimize image quality for consumer and commercial applications.

Addenda known in the art to emit visible light in the blue spectrum are preferred. Consumers generally prefer a slight blue tint to the density minimum areas of a developed image defined as a negative b* compared to a neutral density minimum defined as a b* within one b* unit of zero. b* is the measure of yellow/blue in CIE (Commission Internationale de L'Eclairage) space. A positive b* indicates yellow, while a negative b* indicates blue. The addition of addenda that emits in the blue spectrum allows for tinting the support without the addition of colorants which would decrease the whiteness of the image. The preferred emission is between 1 and 5 delta b* units. Delta b* is defined as the b* difference measured when a sample is illuminated with a ultraviolet light source and a light source without any significant ultraviolet energy. Delta b* is the preferred measure to determine the net effect of adding an optical brightener to the top biaxially oriented sheet of this invention. Emissions less than 1 b* unit cannot be noticed by most customers; therefore, is it not cost effective to add optical brightener to the biaxially oriented sheet when the b* is changed by less than 1 b* unit. An emission greater that 5 b* units would interfere with the color balance of the images making the whites appear too blue for most consumers.

The preferred addenda is an optical brightener. An optical brightener is a colorless, fluorescent, organic compound that absorbs ultraviolet light and emits it as visible blue light. Examples include, but are not limited to, derivatives of 4,4'-diaminostilbene-2,2'-disulfonic acid, coumarin derivatives such as 4-methyl-7-diethylaminocoumarin, 1-4-Bis(O-Cyanostyryl)Benzol and 2-Amino-4-Methyl Phenol.

The voids provide added opacity to the flexible substrate. This voided layer can also be used in conjunction with a layer that contains at least one pigment from the group consisting of $TiO_2$, $CaCO_3$, clay, $BaSO_4$, ZnS, $MgCO_3$, talc, kaolin, or other materials that provide a highly reflective white layer in said film of more than one layer. The combination of a pigmented layer with a voided layer provides advantages in the optical performance of the final image.

Voided layers of the flexible face stock substrate are more susceptible than solid layers to mechanical failure, such as cracking or delamination from adjacent layers. Voided structures that contain $TiO_2$, or are in proximity to layers containing $TiO_2$, are particularly susceptible to loss of mechanical properties and mechanical failure with long-term exposure to light. $TiO_2$ particles initiate and accelerate the photooxidative degradation of polypropylene. The addition of a hindered amine stabilizer to at least one layer of a multilayer biaxially oriented film and in the preferred embodiment in the layers containing $TiO_2$ and, furthermore, in the most preferred embodiment the hindered amine is in the layer with $TiO_2$, as well as in the adjacent layers, that improvements to both light and dark keeping image stability are achieved.

The polymer face stock substrate preferably contains a stabilizing amount of hindered amine at or about 0.01 to 5% by weight in at least one layer of said film. While these levels provide improved stability to the biaxially oriented film, the preferred amount at or about 0.1 to 3% by weight provides an excellent balance between improved stability for both light and dark keeping, while making the structure more cost effective.

The hindered amine light stabilizer (HALS) may come from the common group of hindered amine compounds originating from 2,2,6,6-tetramethylpiperidine, and the term hindered amine light stabilizer is accepted to be used for hindered piperidine analogs. The compounds form stable nitroxyl radicals that interfere with photooxidation of polypropylene in the presence of oxygen, thereby affording excellent long-term photographic stability of the imaging element. The hindered amine will have sufficient molar mass to minimize migration in the final product, will be miscible with polypropylene at the preferred concentrations, and will not impart color to the final product. In the preferred embodiment, examples of HALS include poly {[6-[(1,1,3,3-tetramethylbutylamino}-1,3,5-triazine-4-piperidinyl)-imino]-1,6-hexanediyl[(2,2,6,6-tetramethyl-4-piperdinyl) imino])}(Chimassorb 944 LD/FL), Chimassorb 119, and bis(1,2,2,6,6-pentamethyl-4-piperidinyl)[3,5-bis(1,1-dimethylethyl-4-hydroxyphenyl)methyl]butylpropanedioate (Tinuvin 144), although they are not limited to these compounds.

In addition, the flexible face stock substrate may contain any of the hindered phenol primary antioxidants commonly used for thermal stabilization of polypropylene, alone, or in combination with a secondary antioxidants. Examples of hindered phenol primary antioxidants include pentaerythrityl tetrakis [3-(3,5-di-tert-butyl-4-hydroxyphenyl) proprionate] (such as Irganox 1010), octadecyl 3-(3,5-di-tert-butyl-4-hydroxyphenyl)propnionate (such as Irganox 1076), benzenepropanoic acid 3,5-bis(1,1-dimethyl)-4-hydroxy-2[3-[3,5-bis(1,1-dimethylethyl)-4-hydroxyphenyl)-1-oxopropyl)hydrazide (such as Irganox MD1024), 2,2'-thiodiethylenebis[3-(3,5-di-tert-butyl-4-hydroxyphenyl)proprionate] (such as Irganox 1035), 1,3,5-trimethyl-2,4,6-tri(3,5-di-tert-butyl-4-hydroxybenzyl)-benzene (such as Irganox 1330), but are not limited to these examples. Secondary antioxidants include organic alkyl and aryl phosphites including examples such as triphenylphosphite (such as Irgastab TPP), tri(n-propylphenyl-phophite) (such as Irgastab SN-55), 2,4-bis(1,1-dimethylphenyl) phosphite (such as Irgafos 168), and in a preferred embodiment would include Irgafos 168. The combination of hindered amines with other primary and secondary antioxidants have a synergistic benefit in a multilayer biaxially oriented polymer sheet by providing thermal stability to polymers such as polypropylene during melt processing and extrusion, and further enhancing their light and dark keeping properties which is not evident in a mono layer system for imaging products such as photographs. These unexpected results provide for a broader range of polymers that can be utilized in imaging product, thus enabling enhanced features to be incorporated into their design.

The optical brightener may be added to any layer in the multilayer coextruded flexible face stock substrate. The preferred location is adjacent to or in the exposed surface layer of said sheet. This allows for the efficient concentration of optical brightener.

When the desired weight percentage loading of the optical brightener begins to approach a concentration at which the optical brightener migrates to the surface of the support forming crystals in the imaging layer, the addition of optical brightener into the layer adjacent to the exposed layer is preferred. In prior art imaging supports that use optical brightener, expensive grades of optical brightener are used to prevent migration into the imaging layer. When optical brightener migration is a concern, as with light sensitive silver halide imaging systems, the preferred exposed layer comprises polyethylene that is substantially free of optical brightener. In this case, the migration from the layer adjacent to the exposed layer is significantly reduced because the exposed surface layer acts as a barrier for optical brightener migration allowing for much higher optical brightener levels to be used to optimize image quality. Further, locating the optical brightener in the layer adjacent to the exposed layer allows for a less expensive optical brightener to be used as the exposed layer, which is substantially free of optical brightener, prevents significant migration of the optical brightener. Another preferred method to reduce unwanted optical brightener migration in biaxially oriented sheets of this invention is to use polypropylene for the layer adjacent to the exposed surface.

The flexible biaxially face stock substrate of this invention which has a microvoided core is preferred. The microvoided core adds opacity and whiteness to the imaging support, further improving imaging quality. Combining the image quality advantages of a microvoided core with a material, which absorbs ultraviolet energy and emits light in the visible spectrum, allows for the unique optimization of image quality, as the image support can have a tint when exposed to ultraviolet energy yet retain excellent whiteness when the image is viewed using lighting that does not contain significant amounts of ultraviolet energy such as indoor lighting.

It has been found that the microvoids located in the voided layer of the flexible biaxially oriented substrate provide a reduction in undesirable pressure fog. Mechanical pressure, of the order of hundreds of kilograms per square centimeter, causes an undesirable, reversible decrease in sensitivity by a mechanism at the time of writing that is not fully understood. The net result of mechanical pressure is an unwanted increase in density, mainly yellow density. The voided layer in the biaxially oriented flexible substrate absorbs mechanical pressure by compression of the voided layer, common in the converting and photographic processing steps, and reduces the amount of yellow density change. Pressure sensitivity is measured by applying a 206 MPa load to the coated light sensitive silver halide emulsion, developing the yellow layer, and measuring the density difference with an X-Rite model 310 (or comparable) photographic transmission densitometer between the control sample which was unloaded and the loaded sample. The preferred change in yellow layer density is less than 0.02 at a pressure of 206 MPa. A 0.04 change in yellow density is perceptually significant and, thus, undesirable.

The coextrusion, quenching, orienting, and heat setting of the flexible face stock substrate may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature and below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers, while restraining to some degree the sheet against retraction in both directions of stretching.

By having at least one nonvoided skin on the microvoided core, the tensile strength of the flexible face stock substrate is increased and makes the sheet more manufacturable. The higher tensile strength also allows the sheets to be made at wider widths and higher draw ratios than when sheets are made with all layers voided. Coextruding the layers further simplifies the manufacturing process.

A flexible label base that is transparent may be preferred. A transparent flexible label base is used to provide a clear pressure sensitive label particularly useful for labeling applications that allow the contents of the package to be viewed though the label. Examples include wine bottle labeling, shampoo bottle labeling and beverage bottles that utilize clear or colored glass. For this invention, "transparent" material is defined as a material that has a spectral transmission greater than 90%. For a imaging element, spectral transmission is the ratio of the transmitted power to the incident power and is expressed as a percentage as follows; $T_{RGB}=10^{-D}*100$ where D is the average of the red, green and blue Status A transmission density response measured by an X-Rite model 310 (or comparable) photographic transmission densitometer:

A flexible label base that has an optical transmission less than 20% is preferred for most applications. Optical transmission less than 20% provide a superior opaque silver halide pressure sensitive label that is highly reflective. Opaque, highly reflective labels are useful for pressure sensitive labeling against a background that is dark and would interfere with the quality of the image. An example would be the labeling of a black package, a label base with optical transmission greater than 20% would darken the image, resulting is a loss of low density detail such as facial detail content.

A pressure sensitive photographic label adhesive is utilized in the invention to allow the developed silver halide packaging label to be adhered to the surface of the package typically utilizing high speed packaging equipment. "Peelable separation" or "peel strength" or "separation force" is a measure of the amount of force required to separate the silver halide label from the package to which the label has been applied. The peel strength is the amount of force required to separate two surfaces that are held together by internal forces of the photographic label adhesive which consist of valence forces or interlocking action, or both. Peel strength is measured using an Instron gauge and peeling the sample at 180 degrees with a crosshead speed of 1.0 meters/min. The sample width is 5 cm and the distance peeled is 10 cm in length.

A peelable photographic label adhesive is utilized to allow the consumer to separate the label from the package. Separation of the label from the package would allow for example, rebate coupons to be attached to the package or used to for consumer promotions. For a peelable photographic label adhesive, the preferred peel strength between the silver halide pressure sensitive label and the package is no greater than 80 grams/cm. A peel strength greater than 100 grams/cm, consumers would begin to have difficulty separating the image from the package. Further, at peel strengths greater than 110 grams/cm, the force is beginning to approach the internal strength of paper substrate, causing an unwanted fracture of the paper substrate before the separation of the image.

Upon separation of the image from the substrate, the peelable photographic label adhesive of this invention has a preferred repositioning peel strength between 20 grams/cm and 100 grams/cm. Repositioning peel strength is the amount of force required to peel the separated image containing an photographic label adhesive from a stainless steel block at 23° C. and 50% RH. At repositioning peel strengths less than 15 grams/cm, the photographic label adhesive lacks sufficient peel strength to remain adhered to a variety of surfaces such as refrigerators or photo albums. At peel strengths greater than 120 grams/cm, the photographic label adhesive of this invention is too aggressive, not allowing the consumer to later reposition the image.

The peelable photographic label adhesive of this invention may be a single layer or two or more layers. For two or more photographic label adhesive layers, one of the photographic label adhesive layers preferentially adheres to the label base. As the image is separated from the substrate, this allows the photographic label adhesive of this invention be adhered to the label base for repositioning.

A substrate that comprises a release layer for a photographic label adhesive that repositions is preferred. The release layer allows for uniform separation of the photographic label adhesive at the photographic label adhesive base interface. The release layer may be applied to the liner by any method known in the art for applying a release layer to substrates. Examples include silicone coatings, tetrafluoroethylene fluorocarbon coatings, fluorinated ethylene-propylene coatings, and calcium stearate.

Suitable peelable photographic label adhesives of this invention must not interact with the light sensitive silver halide imaging system so that image quality is deteriorated. Further, since photographic elements of this invention must be photoprocessed, the performance of the photographic label adhesive of this invention must not be deteriorated by photographic processing chemicals. Suitable photographic label adhesive may be inorganic or organic, natural or synthetic, that is capable of bonding the image to the desired surface by surface attachment. Examples of inorganic photographic label adhesives are soluble silicates, ceramic and thermosetting powdered glass. Organic photographic label adhesives may be natural or synthetic. Examples of natural organic photographic label adhesives include bone glue, soybean starch cellulosics, rubber latex, gums, terpene, mucilages and hydrocarbon resins. Examples of synthetic organic photographic label adhesives include elastomer solvents, polysulfide sealants, theromplastic resins such as isobutylene and polyvinyl acetate, theromsetting resins such as epoxy, phenoformaldehyde, polyvinyl butyral and cyanoacrylates and silicone polymers.

For single or multiple layer photographic label adhesive systems, the preferred photographic label adhesive composition is selected from the group consisting of natural rubber, syntheic rubber, acrylics, acrylic copolymers, vinyl polymers, vinyl acetate-, urethane, acrylate-type materials, copolymer mixtures of vinyl chloride-vinyl acetate, polyvinylidene, vinyl acetate-acrylic acid copolymers, styrene butadiene, carboxylated stryrene butadiene copolymers, ethylene copolymers, polyvinyl alcohol, polyesters and copolymers, cellulosic and modified cellulosic, starch and modified starch compounds, epoxies, polyisocyanate, polyimides.

Water based pressure sensitive adhesion provide some advantages for the manufacturing process of non solvent emissions. Repositionable peelable photographic label adhesive containing non-photographic label adhesive solid particles randomly distributed in the photographic label adhesive layer aids in the ability to stick and then remove the print to get the desired end result. The most preferred pressure sensitive peelable photographic label adhesive is a respositionable photographic label adhesive layer containing at about 5% to 20% by weight of a permanent photographic label adhesive such as isooctyl acrylate/acrylic acid copolymer and at about 95% to 80% by weight of a tacky elastomeric material such as acrylate microspheres with the photographic label adhesive layer coverage at about 5 to 20 $g/m^2$.

The preferred peelable photographic label adhesive materials may be applied using a variety of methods known in the art to produce thin, consistent photographic label adhesive coatings. Examples include gravure coating, rod coating, reverse roll coating, and hopper coating. The photographic label adhesives may be coated on the liner or the face stock materials prior to lamination.

For single or multiple layer photographic label adhesive systems, the preferred permanent photographic label adhesive composition is selected from the group consisting of epoxy, phenoformaldehyde, polyvinyl butyral, cyanoacrylates, rubber based photographic label adhesives, styrene/butadiene based photographic label adhesives, acrylics and vinyl derivatives. Peelable photographic label adhesives and permanent photographic label adhesives may be used in combination in the same layer or in different locations in the photographic support structure. An example of a combination photographic label adhesive structure is a peelable photographic label adhesive between the top biaxially oriented sheet and the base materials and a permanent photographic label adhesive between the bottom biaxially oriented sheet and the base material.

The silver halide imaging layers on a pressure sensitive substrate preferably are applied to a variety of packages in automated labeling equipment. Preferred package types are bottles, can, stand up pouch, box and a bag. The packages may contain materials that require a package for sale. Preferred materials that are packaged include liquids and particulate.

The invention is preferably provided with a peelable back or liner material. A peelable liner or back is preferred as the pressure sensitive adhesive required for adhesion of the label to the package, can not be transported through labeling equipment without the liner. The liner provides strength for conveyance and protects the pressure sensitive adhesive prior to application to the package. A suitable liner material is cellulose paper. A cellulose paper liner is flexible, strong and low in cost compared to polymer substrates. Further, a cellulose paper substrate allows for a textured label surface that can be desirable in some packaging applications. The paper may be provided with coatings that will provide waterproofing to the paper as the photographic element of the invention must be processed in aqueous chemistry to develop the image. An examples of a suitable water proof coatings applied to the paper are acrylic polymer and melt extruded polyethylene.

A preferred liner material or peelable back is a oriented sheet of polymer. The liner preferably is an oriented polymer because of the strength and toughness developed in the orientation process. Preferred polymers for the liner substrate include polyolefins, polyester and nylon. Preferred polyolefin polymers include polypropylene, polyethylene, polymethylpentene, polystyrene, polybutylene, and mixtures thereof. Polyolefin copolymers, including copolymers of propylene and ethylene such as hexene, butene, and octene are also useful. Polyester is most preferred, as it is has desirable strength and toughness properties required for efficient transport of silver halide pressure sensitive label liner in high speed labeling equipment.

The tensile strength of the liner or the tensile stress at which a substrate breaks apart is an important conveyance and forming parameter. Tensile strength is measured by ASTM D882 procedure. A tensile strength greater than 34 MPa is preferred as liners less than 32 MPa begin to fracture in automated packaging equipment during conveyance, forming and application to the package.

The coefficient of friction or COF of the liner containing the silver halide imaging layer is an important characteristic as the COF is related to conveyance and forming efficiency in automated labeling equipment. COF is the ratio of the weight of an item moving on a surface to the force that maintains contact between the surface and the item. The mathematical expression for COF is as follows:

$$COF=\mu=(\text{friction force/normal force})$$

The COF of the liner is measured using ASTM D-1894 utilizing a stainless steel sled to measure both the static and dynamic COF of the liner. The preferred COF for the liner of the invention is between 0.2 and 0.6. As an example, a 0.2 COF is necessary for coating on a label used in a pick-and-place application. The operation using a mechanical device to pick a label and move it to another point requires a low COF so the label will easily slide over the surface of the label below it. At the other extreme, large sheets such as book covers require a 0.6 COF to prevent them from slipping and sliding when they are piled on top of each other in storage. Occasionally, a particular material may require a high COF on one side and a low COF on the other side. Normally, the base material itself, such as a plastic film, foil, or paper substrate, would provide the necessary COF for one side. Application of an appropriate coating would modify the image side to give the higher or lower value. Conceivably, two different coatings could be used with one on either side.

COF can be static or kinetic. The coefficient of static friction is the value at the time movement between the two surfaces is ready to start but no actual movement has occurred. The coefficient of kinetic friction refers to the case when the two surfaces are actually sliding against each other at a constant rate of speed. COF is usually measured by using a sled placed on the surface. The force necessary at the onset of sliding provides a measurement of static COF. Pulling the sled at a constant speed over a given length provides a measure of kinetic frictional force.

The silver halide packaging label of the invention preferably has a thickness of less than 600 $\mu$m. A silver halide packaging label greater than 650 $\mu$m offers no significant improvement in either imaging quality or packaging label performance. Further, transport through high speed packaging equipment is difficult at a photographic label thickness greater than 650 $\mu$m and stripping the photographic labels utilizing the Bernoulli method is difficult if the thickness of the photographic label exceeds 700 $\mu$m.

The following is an example of a preferred opaque, reflective silver halide pressure sensitive label structure that has an environmental protection layer (EPL) applied after photo-processing to the outermost silver halide imaging layer. Polyethylene and polypropylene layers form an integral biaxially oriented pragmatic sheet, to which the pressure sensitive adhesive and liner material are laminated prior to the coating of the light sensitive silver halide imaging layers.

| |
|---|
| 7.5 $\mu$m ground styrene butyl acrylate fused EPL |
| Layer of silver halide formed image |
| Pragmatic sheet |
| Acrylic pressure sensitive adhesive |
| Cellulose paper based liner |

For the label-imaging element of this invention, the imaging layers are typically color corrected to provide a perceptually preferred density minimum. Typical imaging layers that contain gelatin have an inherent or native color that needs correction to obtain a preferred density minimum. For high quality images, a slight blue tint is preferred. Prior art imaging supports have typically incorporated blue tints into the support prior to the coating of the imaging layers. This blue tint can be omitted from the label media, and instead, the native yellowness of the imaging formulation can be corrected by a color-rendering algorithm in a way that "white" or pastel areas of the original image are biased to be reproduced slightly blue and are digitally printed in such a way to achieve this end result. The advantage to this technique is an increase in color gamut of the material, in regions of high lightness. A potential disadvantage to this technique is that the unexposed media bordering the imaged region will appear yellow.

Alternatively, the imaging elements of this invention could incorporate tint materials into the imaging layers to correct the native yellowness of the imaging formulation. For example, in prior art photographic papers, the blue tint material is dispersed into the melt extruded polyethylene layer coated on cellulose paper. The blue tint is added to the polyethylene to correct for the native yellowness of the gelatin used as a carrier of the silver halide imaging layers. Without the tint materials, the density minimum of the photographic would be an undesirable yellow. In the case of a photographic element, blue pigments may be added into one of the silver halide imaging layers to correct for the native yellowness of the gelatin. For a photographic element, it has been found that the addition of the blue tint to the silver halide imaging layers resulted in a 75% reduction in blue tint usage compared to tinting the polyethylene layers.

A unique feature of this invention is the particle size of the pigments used to tint the label imaging layers. The pigments are preferable milled into a particle size less than 1.0 micrometers to improve the dispersion quality and to improve the light absorption characteristics of the pigments. Surprisingly, it has been found that when the pigments used in this invention were milled to less than 0.1 micrometers, the unwanted light absorption of the pigments were reduced producing pigments that were more efficient. Because the ball milled pigments are less than 1.0 micrometer in size the use of an aqueous dispersion is possible avoiding the need for a high boiling point solvents to incorporate the pigments into the gelatin. The aqueous solid particle dispersions also allow for increased concentrations of pigments to be used to overcome the native yellowness of the gelatin layers and to provide consumers with the perceptually preferred blue tint to the density minimum areas of an image. By utilizing aqueous solid particle dispersions pigments, pigment concentrations in the gelatin layer are greater than 0.006 mg/M$^2$. Pigments concentrations above 0.006 mg/m$^2$ are preferred because concentrations above 0.006 mg/m$^2$ are required to offset the native yellowness of silver halide and ink jet receiving layers.

The following is a description of a light sensitive silver halide emulsion capable of accurately reproducing flesh tones. The image density produced by this emulsion is sufficient for non-backlit display. Photographic display materials using clear support are typically formulated with higher coverage of dye forming material. The higher densities formed are suitable for viewing with one pass of light, as in a backlit display. In labeling, the labels are typically viewed on a package with reflected light. The light is modulated by the dyes in the image twice, which results in twice the amount of perceived density. Thus, low coverage of dye forming material is not only possible but advantageous, resulting in quicker processing times and lower cost of materials.

This invention is also directed to a silver halide packaging label capable of excellent performance when exposed by either an electronic printing method or a conventional optical printing method. An electronic printing method comprises subjecting a radiation sensitive silver halide emulsion layer of a recording element to actinic radiation of at least $10^{-4}$ ergs/cm$^2$ for up to 100$\mu$ seconds duration in a pixel-by-pixel mode wherein the silver halide emulsion layer is comprised of silver halide grains as described above. A conventional optical printing method comprises subjecting a radiation sensitive silver halide emulsion layer of a recording element to actinic radiation of at least $10^{-4}$ ergs/cm$^2$ for $10^{31\ 3}$ to 300 seconds in an imagewise mode wherein the silver halide emulsion layer is comprised of silver halide grains as described above.

This invention in a preferred embodiment utilizes a radiation-sensitive emulsion comprised of silver halide grains (a) containing greater than 50 mole percent chloride, based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula $$[ML_6]^n \quad \text{(I)}$$

wherein n is zero, −1, −2, −3 or −4; M is a filled frontier orbital polyvalent metal ion, other than iridium, and $L_6$ represents bridging ligands which can be independently selected, provided that least four of the ligands are anionic ligands, and at least one of the ligands is a cyano ligand or a ligand more electronegative than a cyano ligand; and (ii) an iridium coordination complex containing a thiazole or substituted thiazole ligand.

This invention is directed towards a photographic label comprising a flexible substrate and at least one light sensitive silver halide emulsion layer comprising silver halide grains as described above. The photographic label may be color or black and white where silver is retained in the developed imaging layer to form density.

It has been discovered quite surprisingly that the combination of dopants (i) and (ii) provides greater reduction in reciprocity law failure than can be achieved with either dopant alone. Further, unexpectedly, the combination of dopants (i) and (ii) achieve reductions in reciprocity law failure beyond the simple additive sum achieved when employing either dopant class by itself. It has not been reported or suggested prior to this invention that the combination of dopants (i) and (ii) provides greater reduction in reciprocity law failure, particularly for high intensity and short duration exposures. The combination of dopants (i) and (ii) further unexpectedly achieves high intensity reciprocity with iridium at relatively low levels, and both high and low intensity reciprocity improvements even while using conventional gelatino-peptizer (e.g., other than low methionine gelatino-peptizer).

In a preferred practical application, the advantages of the invention can be transformed into increased throughput of digital substantially artifact-free color print images while exposing each pixel sequentially in synchronism with the digital data from an image processor.

In one embodiment, the present invention represents an improvement on the electronic printing method. Specifically, this invention in one embodiment is directed to an electronic printing method which comprises subjecting a radiation sensitive silver halide emulsion layer of a recording element to actinic radiation of at least $10^{-4}$ ergs/cm$^2$ for up to 100 $\mu$ seconds duration in a pixel-by-pixel mode. The present invention realizes an improvement in reciprocity failure by selection of the radiation sensitive silver halide emulsion layer. While certain embodiments of the invention are specifically directed towards electronic printing, use of the emulsions and elements of the invention is not limited to such specific embodiment, and it is specifically contemplated that the emulsions and elements of the invention are also well suited for conventional optical printing. Thus, it is highly desirable that the element of the invention has speed (sensitivity) and contrast characteristics that are invariant with exposure time. Exposing devices for color papers may include light sources consisting of tungsten lamps, halogen lamps, lasers, light emitting photodiodes (LED's), liquid crystal displays (LCD's) or other light sources. To accommodate this variety of exposing devices, the emulsions used in the element are capable of recording the exposure between the exposure range of nanoseconds ($1\times10^{-9}$ seconds) to several minutes while maintaining printing speed and contrast.

Emulsions in accordance with the invention comprise high chloride silver halide grains having an average equivalent spherical diameter of less than 0.9 micrometer (preferably less than about 0.7 micrometer and more preferably less than about 0.5 micrometer), which include a doped inner core and an outer dopant band separated by at least 10 percent (preferably at least 20 percent, more preferably at least 30 percent, even more preferably at least 40 percent and most preferably at least 50 percent) of the total silver of the emulsion grains. The dopant in the outer dopant band is a shallow electron trapping hexacoordination complex dopant of Formula (I):

$$[ML_6]^n \quad \text{(I)}$$

where n is zero, −1, −2, −3 or −4; M is a filled frontier orbital polyvalent metal ion, other than iridium, preferably $Fe^{+2}$, $Ru^{+2}$, $Os^{+2}$, $Co^{+3}$, $Rh^{+3}$, $Pd^{+4}$ or $Pt^{+4}$, more preferably an iron, ruthenium or osmium ion, and most preferably a ruthenium ion; and $L_6$ represents six bridging ligands which can be independently selected, provided that least four of the ligands are anionic ligands and at least one (preferably at least 3 and optimally at least 4) of the ligands is a cyano ligand or a ligand more electronegative than a cyano ligand. Any remaining ligands can be selected from among various other bridging ligands, including aquo ligands, halide ligands (specifically, fluoride, chloride, bromide and iodide), cyanate ligands, thiocyanate ligands, selenocyanate ligands, tellurocyanate ligands, and azide ligands. Hexacoordinated transition metal complexes of Formula (I) which include six cyano ligands are specifically preferred.

Illustrations of specifically contemplated Formula (I) hexacoordination complexes for inclusion in the high chloride grains are provided by Bell U.S. Pat. Nos. 5,474,888, 5,470,771 and 5,500,335, Olm et al U.S. Pat. No. 5,503,970 and Daubendiek et al U.S. Pat. Nos. 5,494,789 and 5,503,971, and Keevert et al U.S. Pat. No. 4,945,035, the disclosures of which are here incorporated by reference, as well as Murakami et al Japanese Patent Application Hei-2[1990]-249588, and *Research Disclosure* Item 36736, the disclosures of which are here incorporated by reference. Useful neutral and anionic organic ligands for dopant hexacoordination complexes are disclosed by Olm et al U.S. Pat. No. 5,360,712 and Kuromoto et al U.S. Pat. No. 5,462,849, the disclosures of which are here incorporated by reference.

The following are specific illustrations of Formula (I) dopants:

$[Fe(CN)_6]^{-4}$ (I-1)

$[Ru(CN)_6]^{-4}$ (I-2)

$[Os(CN)_6]^{-4}$ (I-3)

$[Rh(CN)_6]^{-3}$ (I-4)

$[Fe(pyrazine)(CN)_5]^{-3}$ (I-6)

$[RuCl](CN)_5]^{-4}$ (I-7)

$[OsBr(CN)_5]^{-4}$ (I-8)

$[RhF(CN)_5]^{-3}$ (I-9)

$[In(NCS)_6]^{-3}$ (I-10)

$[FeCO(CN)_5]^{-3}$ (I-11)

$[RuF_2(CN)_4]^{-4}$ (I-12)

$[OsCl_2(CN)_4]^{-4}$ (I-13)

$[RhI_2(CN)_4]^{-3}$ (I-14)

$[Ga(NCS)_6]^3$ (I-15)

$[Ru(CN)_5(OCN)]^{-4}$ (I-16)

$[Ru(CN)_5(N_3)]^{-4}$ (I-17)

$[Os(CN)_5(SCN)]^{-4}$ (I-18)

$[Rh(CN)_5(SeCN)]^{-3}$ (I-19)

$[Os(CN)Cl_5]^{-4}$ (I-20)

$[Fe(CN)_3Cl_3]^{-4}$ (I-21)

$[Ru(CO)_2(CN)_4]^{-2}$ (I-22)

When the Formula (I) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. It is noted that the same comments apply to Formula (11) dopants, otherwise described below.

Further in accordance with the invention, a second dopant is located in the high chloride grains within an inner core comprising up to 60 percent (preferably up to 50 percent, more preferably up to 40 percent and most preferably up to 30 percent) of the total silver, which doped inner core is separated from the outer dopant band by at least 10 percent (preferably at least 20 percent, more preferably at least 30 percent, even more preferably at least 40 percent and most preferably at least 50 percent) of the total silver. The dopant in the inner core is a contrast increasing hexacoordination complex dopant of Formula (II):

$$[TE_4(NZ)E']^r \quad \text{(II)}$$

wherein T is Os or Ru; E is a bridging ligand, E' is E or NZ, r is zero, −1, −2 or −3, and Z is oxygen or sulfur. The E ligands can take the form of any independently selected remaining bridging ligands, including aquo ligands, halide ligands (specifically, fluoride, chloride, bromide and iodide), cyano ligand, cyanate ligands, thiocyanate ligands, selenocyanate ligands, tellurocyanate ligands, and azide ligands. Cyano and halide ligands are generally preferred, and hexacoordinated transition metal complexes of Formula (II) which include 5 halide or cyano ligands are specifically preferred. Suitable coordination complexes satisfying the above formula are found in McDugle et al U.S. Pat. No. 4,933,272, the disclosure of which is here incorporated by reference.

The following are specific illustrations of Formula (II) compounds:

$$[Os(NO)Cl_5]^{-2} \quad \text{(II-1)}$$

$$[Ru(NO)Cl_5]^{-2} \quad \text{(II-2)}$$

$$[Os(NO)Br_5]^{-2} \quad \text{(II-3)}$$

$$[Ru(NO)Br_5]^{-2} \quad \text{(II-4)}$$

$$[Ru(NO)I_5]^{-2} \quad \text{(II-5)}$$

$$[Os(NS)Br_5]^{-2} \quad \text{(II-6)}$$

$$[Ru(NS)Cl_5]^{-2} \quad \text{(II-7)}$$

The most preferred nitrosyl ligand containing osmium-based transition metal complex is $[Os(NO)Cl_5]^{-2}$, which prior to its incorporation into a silver halide grain is associated with a cation, typically 2 $Cs^{+1}$.

The Formula (II) dopant can be distributed throughout the inner core, or can be added at one or more specific locations therein. Dopant of Formula (I), subject to the requirement that it be separated from the doped inner core by at least 10 percent of total silver, is preferably introduced into the high chloride grains after at least 50 (most preferably 75 and optimally 80) percent of the silver has been precipitated for such grains, but before precipitation of the central portion of the grains has been completed. Preferably dopant of Formula (I) is introduced before 98 (most preferably 95 and optimally 90) percent of the silver has been precipitated. Stated in terms of the fully precipitated grain stricture, the Formula (I) dopant is preferably present in an interior shell region that surrounds at least 50 (most preferably 75 and optimally 80) percent of the silver and, with the more centrally located silver, accounts the entire central portion (99 percent of the silver), most preferably accounts for 95 percent, and optimally accounts for 90 percent of the silver halide forming the high chloride grains. The Formula (I) dopant can be distributed throughout the interior shell region delimited above or can be added as one or more bands within the interior shell region.

The silver halide grains preferably contain from $10^{-8}$ to $10^{-3}$ mole (more preferably from $10^{-7}$ to $10^{-4}$ mole) of a dopant of Formula (I), and from $10^{-11}$ to $10^{-6}$ mole (more preferably from $10^{-10}$ to $10^{-7}$ mole) of a hexacoordination metal complex of Formula (II) per total mole of silver. Providing a separation of at least 10 percent of total silver between locations of the two dopants allows for the use of higher levels of dopant than would otherwise be possible without disadvantageous levels of latent image keeping problems.

The silver halide grains of photographic emulsions in accordance with the invention may also include other dopants. Doping with iridium hexachloride complexes, e.g., is commonly performed to reduce reciprocity law failure in silver halide emulsions. According to the photographic law of reciprocity, a photographic element should produce the same image with the same exposure, even though exposure intensity and time are varied. For example, an exposure for 1 second at a selected intensity should produce exactly the same result as an exposure of 2 seconds at half the selected intensity. When photographic performance is noted to diverge from the reciprocity law, this is known as reciprocity failure. Specific iridium dopants include those illustrated in high chloride emulsions by Bell U.S. Pat. Nos. 5,474,888, 5,470,771 and 5,500,335 and McIntyre et al U.S. Pat. No. 5,597,686. Specific combinations of iridium and other metal dopants may additionally be found in U.S. Pat. Nos. 4,828, 962, 5,153,110, 5,219,722, 5,227,286, and 5,229,263, and European Patent Applications EP 0 244 184, EP 0405938, EP 0476602, EP 0488601, EP 0488737, EP 0513748, and EP 0 514 675. In accordance with particularly preferred embodiments, an iridium coordination complex containing at least one thiazole or substituted thiazole ligand may be employed. The thiazole ligands may be substituted with any photographically acceptable substituent which does not prevent incorporation of the dopant into the silver halide grain. Exemplary substituents include lower alkyl (e.g., alkyl groups containing 1–4 carbon atoms), and specifically methyl. A specific example of a substituted thiazole ligand which may be used in accordance with the invention is 5-methylthiazole. The iridium dopant preferably is a hexacoordination complex having ligands each of which are more electropositive than a cyano ligand. In a specifically preferred form the remaining non-thiazole or non-substituted-thiazole ligands of the iridium coordination complex dopants are halide ligands.

Iridium dopant is preferably introduced into the high chloride grains of each of the first and second portions after at least 50 (most preferably 85 and optimally 90) percent of the silver has been precipitated, but before precipitation of the central portion of the grains has been completed. Preferably iridium dopant is introduced before 99 (most preferably 97 and optimally 95) percent of the silver has been precipitated. Stated in terms of the fully precipitated grain structure, iridium dopant is preferably present in an interior shell region that surrounds at least 50 (most preferably 85 and optimally 90) percent of the silver and, with the more centrally located silver, accounts the entire central portion (99 percent of the silver), most preferably accounts for 97 percent, and optimally accounts for 95 percent of the silver halide forming the high chloride grains. The iridium dopant can be distributed throughout the interior shell region delimited above or can be added as one or more bands within the interior shell region. Iridium dopant can be employed in any conventional useful concentration. A preferred concentration range is from $10^{-9}$ to $10^{-4}$ mole per silver mole. Iridium is most preferably employed in a concentration range of from $10^{-8}$ to $10^{-5}$ mole per silver mole. Specific illustrations of iridium dopants include the following:

$$[IrCl_5(\text{thiazole})]^{-2} \quad \text{(Ir-1)}$$

$$[IrCl_4(\text{thiazole})_2]^{-1} \quad \text{(Ir-2)}$$

$$[IrBr_5(\text{thiazole})]^{-2} \quad \text{(Ir-3)}$$

$$[IrBr_4(\text{thiazole})_2]^{-1} \quad \text{(Ir-4)}$$

$$[IrCl_5(\text{5-methylthiazole})]^{-2} \quad \text{(Ir-5)}$$

$$[IrCl_4(\text{5-methylthiazole})_2]^{-1} \quad \text{(Ir-6)}$$

$[IrBr_4(5\text{-methylthiazole})]^{-2}$ (Ir-7)

$[IrBr_4(5\text{-methylthiazole})_2]^{-1}$ (Ir-8)

$[IrCl_6]^{-2}$ (Ir-9)

$[IrCl_6]^{-3}$ (Ir-10)

$[IrBr_6]^{-2}$ (Ir-11)

$[IrBr_6]^{-3}$ (Ir-12)

As with dopants of Formula (I) and (II), when iridium dopants have a net negative charge, it is appreciated that they are associated with a counter ion when added to the reaction vessel during precipitation. Common counter ions known to be fully compatible with silver chloride precipitation, such as ammonium and alkali metal ions, are contemplated.

Most preferably, the first dopant of Formula (I) and the Iridium dopant are contained in a common dopant band within the central portion of the high chloride emulsion grains. Emulsions demonstrating the advantages of the invention can be realized by modifying the precipitation of conventional high chloride silver halide grains having predominantly (>50%) {100} crystal faces to obtain grains incorporating the above described first and liridium dopants as described above within a common dopant band. To be located within a common dopant band, both dopants should be introduced concurrently (either by separate jets or by a common jet) into a silver halide reaction vessel during precipitation of at least a part of the central portion of the emulsion grains. The dopants are preferably introduced into the high chloride grains after at least 50 (most preferably 70 and optimally 75) percent of the silver has been precipitated for such grains, but before precipitation of the central portion of the grains has been completed. Preferably, both dopants are introduced before 98 (most preferably 95 and optimally 90) percent of the silver has been precipitated. Stated in terms of the fully precipitated grain structure, the first dopant of Formula (I) and the Iridium dopant comprising an iridium complex are preferably present together in an interior shell region that surrounds at least 50 (most preferably 70 and optimally 75) percent of the silver and, with the more centrally located silver, accounts the entire central portion (99 percent of the silver), most preferably accounts for 95 percent, and optimally accounts for 90 percent of the silver halide forming the high chloride grains.

Emulsions demonstrating the advantages of the invention can be realized by modifying the precipitation of conventional high chloride silver halide grains having predominantly (>50%) {100} crystal faces to obtain grains incorporating the dopants of Formula (I) and Formula (II) as described above. The performance improvement described in accordance with the invention may be obtained for silver halide grains employing conventional gelatino-peptizer, as well as oxidized gelatin (e.g., gelatin having less than 30 micromoles of methionine per gram). Accordingly, in specific embodiments of the invention, it is specifically contemplated to use significant levels (i.e., greater than 1 weight percent of total peptizer) of conventional gelatin (e.g., gelatin having at least 30 micromoles of methionine per gram) as a gelatino-peptizer for the silver halide grains of the emulsions of the invention. In preferred embodiments of the invention, gelatino-peptizer is employed which comprises at least 50 weight percent of gelatin containing at least 30 micromoles of methionine per gram, as it is frequently desirable to limit the level of oxidized low methionine gelatin which may be used for cost and certain performance reasons.

The silver halide grains precipitated contain greater than 50 mole percent chloride, based on silver. Preferably the grains contain at least 70 mole percent chloride and, optimally at least 90 mole percent chloride, based on silver. Iodide can be present in the grains up to its solubility limit, which is in silver iodochloride grains, under typical conditions of precipitation, about 11 mole percent, based on silver. It is preferred for most photographic applications to limit iodide to less than 5 mole percent iodide, most preferably less than 2 mole percent iodide, based on silver.

Silver bromide and silver chloride are miscible in all proportions. Hence, any portion, up to 50 mole percent, of the total halide not accounted for chloride and iodide, can be bromide. For color reflection print (i.e., color paper) uses bromide is typically limited to less than 10 mole percent based on silver and iodide is limited to less than 1 mole percent based on silver.

In a widely used form high chloride grains are precipitated to form cubic grains, that is, grains having {(100} major faces and edges of equal length. In practice ripening effects usually round the edges and corners of the grains to some extent. However, except under extreme ripening conditions substantially more than 50 percent of total grain surface area is accounted for by {100} crystal faces.

High chloride tetradecahedral grains are a common variant of cubic grains. These grains contain 6 {100} crystal faces and 8 {111} crystal faces. Tetradecahedral grains are within the contemplation of this invention to the extent that greater than 50 percent of total surface area is accounted for by {100} crystal faces.

Although it is common practice to avoid or minimize the incorporation of iodide into high chloride grains employed in color paper, it is has been recently observed that silver iodochloride grains with {100} crystal faces and, in some instances, one or more {111} faces offer exceptional levels of photographic speed. In the these emulsions iodide is incorporated in overall concentrations of from 0.05 to 3.0 mole percent, based on silver, with the grains having a surface shell of greater than 50 Å that is substantially free of iodide and a interior shell having a maximum iodide concentration that surrounds a core accounting for at least 50 percent of total silver. Such grain structures are illustrated by Chen et al EPO 0 718 679.

In another improved form the high chloride grains can take the form of tabular grains having {100} major faces. Preferred high chloride {100} tabular grain emulsions are those in which the tabular grains account for at least 70 (most preferably at least 90) percent of total grain projected area. Preferred high chloride {100} tabular grain emulsions have average aspect ratios of at least 5 (most preferably at least >8). Tabular grains typically have thicknesses of less than 0.3 $\mu$m, preferably less than 0.2 $\mu$m, and optimally less than 0.07 $\mu$m. High chloride {100} tabular grain emulsions and their preparation are disclosed by Maskasky U.S. Pat. Nos. 5,264,337 and 5,292,632, House et al U.S. Pat. No. 5,320,938, Brust et al U.S. Pat. No. 5,314,798 and Chang et al U.S. Pat. No. 5,413,904, the disclosures of which are here incorporated by reference.

Once high chloride grains having predominantly {100} crystal faces have been precipitated doped with a combination of dopants of Formula (I) and Formula (II) described above, chemical and spectral sensitization, followed by the addition of conventional addenda to adapt the emulsion for the imaging application of choice can take any convenient conventional form. The conventional features are further illustrated by *Research Disclosure*, Item 38957, cited above, particularly:

III. Emulsion washing;

IV. Chemical sensitization;

V. Spectral sensitization and desensitization;

VII. Antifoggants and stabilizers;

VIII. Absorbing and scattering materials;

IX. Coating and physical property modifying addenda; and

X. Dye image formers and modifiers.

As pointed out by Bell, cited above, some additional silver halide, typically less than 1 percent, based on total silver, can be introduced to facilitate chemical sensitization. It is also recognized that silver halide can be epitaxially deposited at selected sites on a host grain to increase its sensitivity. For example, high chloride {100} tabular grains with corner epitaxy are illustrated by Maskasky U.S. Pat. No. 5,275,930. For the purpose of providing a clear demarcation, the term "silver halide grain" is herein employed to include the silver necessary to form the grain up to the point that the final {100} crystal faces of the grain are formed. Silver halide later deposited that does not overlie the {100} crystal faces previously formed accounting for at least 50 percent of the grain surface area is excluded in determining total silver forming the silver halide grains. Thus, the silver forming selected site epitaxy is not part of the silver halide grains while silver halide that deposits and provides the final {100} crystal faces of the grains is included in the total silver forming the grains, even when it differs significantly in composition from the previously precipitated silver halide.

Emulsions demonstrating the advantages of the invention can be realized by modifying the precipitation of conventional high chloride silver halide grains having predominantly (>50%) {100} crystal faces to obtain separate fractions of grains incorporating the dopants of Formula (I) and Formula (II) as described above, and subsequently blending the two fractions of grains into a single emulsion layer, wherein (i) the first fraction comprises from 10–90 wt % of the silver halide grains, based on total radiation-sensitive silver halide in the layer, consisting of grains which have a central portion accounting for up to 99 percent of total silver which contains at least $10^{-7}$ mole of a hexacoordination metal complex which satisfies formula (I) per mole of silver and less than $10^{-10}$ mole of a hexacoordination metal complex which satisfies formula (II) per mole of silver, and (ii) the second fraction comprises from 10–90 wt % of the silver halide grains, based on total radiation-sensitive silver halide in the layer, consisting of grains which have a central portion accounting for up to 99 percent of total silver which contains at least $10^{-10}$ mole of a hexacoordination metal complex which satisfies the formula (II) per mole of silver and less than $10^{-7}$ mole of a hexacoordination metal complex which satisfies the formula (I) per mole of silver.

Similarly, each of the light sensitive imaging layers of the element may include a single type of silver halide emulsion, or alternatively, may incorporate a blend of different types of emulsions to create, as a function of exposure, a unique density profile after photographic process development. The developed density vs. log exposure relationship of any light sensitive photographic media is commonly referred to as a D vs. log-E curve. Traditional photographic materials employ an S-shaped curve. Particularly useful D vs. log-E curves for this invention are described in patents U.S. Pat. No. 6,312,880 (ROBERTS) and U.S. Pat. No. 5,418,118 (REMBRANDT).

Image dye-forming couplers may be included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 491,197; 544,322; 556,700; 556,777; 565,096; 570,006; and 574,948.

Typical cyan couplers are represented by the following formulas:

CYAN-1

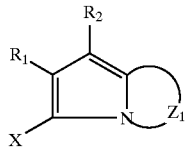

CYAN-2

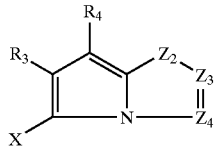

CYAN-3

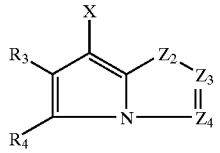

CYAN-4

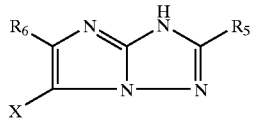

wherein $R_1$, $R_5$ and $R_8$ each represent a hydrogen or a substituent; $R_2$ represents a substituent; $R_3$, $R_4$ and $R_7$ each represent an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant σpara of 0.35 or more; X represents a hydrogen or a coupling-off group; $Z_1$ represents nonmetallic atoms necessary for forming a nitrogen-containing, six-membered, heterocyclic ring which has at least one dissociative group; $Z_2$ represents —C($R_7$)═ and —N═, and $Z_3$ and $Z_4$ each represent —C($R_8$)═ and —N═.

For purposes of this invention, an "NB coupler" is a dye-forming coupler which is capable of coupling with the developer 4-amino-3-methyl-N-ethyl-N-(2-methanesulfonamidoethyl) aniline sesquisulfate hydrate to form a dye for which the left bandwidth (LBW) of its absorption spectra upon "spin coating" of a 3% w/v solution of the dye in di-n-butyl sebacate solvent is at least 5 nm. less than the LBW for a 3% w/v solution of the same dye in acetonitrile. The LBW of the spectral curve for a dye is the distance between the left side of the spectral curve and the wavelength of maximum absorption measured at a density of half the maximum.

The "spin coating" sample is prepared by first preparing a solution of the dye in di-n-butyl sebacate solvent (3% w/v).

If the dye is insoluble, dissolution is achieved by the addition of some methylene chloride. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "NB couplers" form a dye which, in n-butyl sebacate, has a LBW of the absorption spectra upon "spin coating" which is at least 15 nm, preferably at least 25 nm, less than that of the same dye in a 3% solution (w/v) in acetonitrile.

In a preferred embodiment the cyan dye-forming "NB coupler" useful in the invention has the formula (IA)

(IA)

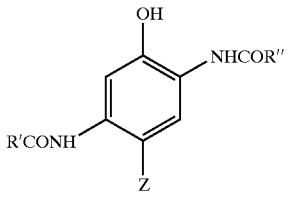

wherein

R' and R are substituents selected such that the coupler is a "NB coupler", as herein defined; and Z is a hydrogen atom or a group which can be split off by the reaction of the coupler with an oxidized color developing agent.

The coupler of formula (IA) is a 2,5-diamido phenolic cyan coupler wherein the substituents R' and R" are preferably independently selected from unsubstituted or substituted alkyl, aryl, amino, alkoxy and heterocyclyl groups.

In a further preferred embodiment, the "NB coupler" has the formula (I):

(I)

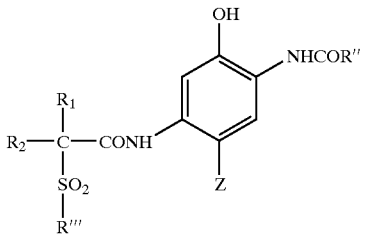

wherein

R" and R'" are independently selected from unsubstituted or substituted alkyl, aryl, amino, alkoxy and heterocyclyl groups and Z is as hereinbefore defined, $R_1$ and $R_2$ are independently hydrogen or an unsubstituted or substituted alkyl group, and Typically, R" is an alkyl, amino or aryl group, suitably a phenyl group. R'" is desirably an alkyl or aryl group or a 5–10 membered heterocyclic ring which contains one or more heteroatoms selected from nitrogen, oxygen and sulfur, which ring group is unsubstituted or substituted.

In the preferred embodiment the coupler of formula (I) is a 2,5-diamido phenol in which the 5-amido moiety is an amide of a carboxylic acid which is substituted in the alpha position by a particular sulfone ($—SO_2^-$) group, such as, for example, described in U.S. Pat. No. 5,686,235. The sulfone moiety is an unsubstituted or substituted alkylsulfone or a heterocyclyl sulfone or it is an arylsulfone, which is preferably substituted, in particular in the meta and/or para position.

Couplers having these structures of formulae (I) or (IA) comprise cyan dye-forming "NB couplers" which form image dyes having very sharp-cutting dye hues on the short wavelength side of the absorption curves with absorption maxima ($\lambda_{max}$) which are shifted hypsochromically and are generally in the range of 620–645 nm, which is ideally suited for producing excellent color reproduction and high color saturation in color photographic packaging labels.

Referring to formula (I), $R_1$ and $R_2$ are independently hydrogen or an unsubstituted or substituted alkyl group, preferably having from 1 to 24 carbon atoms and in particular 1 to 10 carbon atoms, suitably a methyl, ethyl, n-propyl, isopropyl, butyl or decyl group or an alkyl group substituted with one or more fluoro, chloro or bromo atoms, such as a trifluoromethyl group. Suitably, at least one of $R_1$ and $R_2$ is a hydrogen atom and if only one of $R_1$ and $R_2$ is a hydrogen atom then the other is preferably an alkyl group having 1 to 4 carbon atoms, more preferably one to three carbon atoms and desirably two carbon atoms.

As used herein and throughout the specification unless where specifically stated otherwise, the term "alkyl" refers to an unsaturated or saturated straight or branched chain alkyl group, including alkenyl, and includes aralkyl and cyclic alkyl groups, including cycloalkenyl, having 3–8 carbon atoms and the term 'aryl' includes specifically fused aryl.

In formula (I), R" is suitably an unsubstituted or substituted amino, alkyl or aryl group or a 5–10 membered heterocyclic ring which contains one or more heteroatoms selected from nitrogen, oxygen and sulfur, which ring is unsubstituted or substituted, but is more suitably an unsubstituted or substituted phenyl group.

Examples of suitable substituent groups for this aryl or heterocyclic ring include cyano, chloro, fluoro, bromo, iodo, alkyl- or aryl-carbonyl, alkyl- or aryl-oxycarbonyl, carbonamido, alkyl- or aryl-carbonamido, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfonamido, aryl, alkyl, alkoxy, aryloxy, nitro, alkyl- or aryl-ureido and alkyl- or aryl-carbamoyl groups, any of which may be further substituted. Preferred groups are halogen, cyano, alkoxycarbonyl, alkylsulfamoyl, alkyl-sulfonamido, alkylsulfonyl, carbamoyl, alkylcarbamoyl or alkylcarbonamido. Suitably, R" is a 4-chlorophenyl, 3,4-di-chlorophenyl, 3,4-difluorophenyl, 4-cyanophenyl, 3-chloro-4-cyanophenyl, pentafluorophenyl, or a 3- or 4-sulfonamidophenyl group.

In formula (I), when R'" is alkyl it may be unsubstituted or substituted with a substituent such as halogen or alkoxy. When R'" is aryl or a heterocycle, it may be substituted. Desirably it is not substituted in the position alpha to the sulfonyl group.

In formula (I), when R'" is a phenyl group, it may be substituted in the meta and/or para positions with one to three substituents independently selected from the group consisting of halogen, and unsubstituted or substituted alkyl, alkoxy, aryloxy, acyloxy, acylamino, alkyl- or aryl-sulfonyloxy, alkyl- or aryl-sulfamoyl, alkyl- or aryl-sulfamoylamino, alkyl- or aryl-sulfonamido, alkyl- or aryl-ureido, alkyl- or aryl-oxycarbonyl, alkyl- or aryl-oxycarbonylamino and alkyl- or aryl-carbamoyl groups.

In particular each substituent may be an alkyl group such as methyl, t-butyl, heptyl, dodecyl, pentadecyl, octadecyl or 1,1,2,2-tetramethylpropyl; an alkoxy group such as methoxy, t-butoxy, octyloxy, dodecyloxy, tetradecyloxy, hexadecyloxy or octadecyloxy; an aryloxy group such as phenoxy, 4-t-butylphenoxy or 4-dodecyl-phenoxy; an alkyl- or aryl-acyloxy group such as acetoxy or dodecanoyloxy; an alkyl- or aryl-acylamino group such as acetamido, hexadecanamido or benzamido; an alkyl- or aryl-sulfonyloxy group such as methyl-sulfonyloxy, dodecylsulfonyloxy or 4-methylphenyl-sulfonyloxy; an alkyl- or aryl-sulfamoyl-group such as N-butylsulfamoyl or N-4-t-butylphenylsulfamoyl; an alkyl- or aryl-sulfamoylamino group such as N-butyl-sulfamoylamino or N-4-t-butylphenylsulfamoyl-amino; an alkyl- or aryl-sulfonamido group such as methane-sulfonamido, hexadecanesulfonamido or 4-chlorophenyl-sulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxy-carbonylamino or phenoxycarbonylamino, an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably the above substituent groups have 1 to 30 carbon atoms, more preferably 8 to 20 aliphatic carbon atoms. A desirable substituent is an alkyl group of 12 to 18 aliphatic carbon atoms such as dodecyl, pentadecyl or octadecyl or an alkoxy group with 8 to 18 aliphatic carbon atoms such as dodecyloxy and hexadecyloxy or a halogen such as a meta or para chloro group, carboxy or sulfonamido. Any such groups may contain interrupting heteroatoms such as oxygen to form e.g. polyalkylene oxides.

In formula (I) or (IA) Z is a hydrogen atom or a group which can be split off by the reaction of the coupler with an oxidized color developing agent, known in the photographic art as a 'coupling-off group' and may preferably be hydrogen, chloro, fluoro, substituted aryloxy or mercaptotetrazole, more preferably hydrogen or chloro.

The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclylsulfonamido, heterocyclylthio, benzothiazolyl, phosophonyloxy, alkylthio, arylthio, and arylazo. These coupling-off groups are described in the art, for example, in U.S. Pat. Nos. 2,455,169; 3,227,551; 3,432,521; 3,467,563; 3,617,291; 3,880,661; 4,052,212; and 4,134,766, and in U.K. Patent Nos. and published applications 1,466,728; 1,531,927; 1,533,039, 2,066,755A, and 2,017,704A. Halogen, alkoxy and aryloxy groups are most suitable.

Examples of specific coupling-off groups are —Cl, —F, —Br, —SCN, —$OCH_3$, —$OC_6H_5$, —OCH2C(=O)$NHCH_2CH_2OH$, —$OCH_2C(O)NHCH_2CH_2OCH_3$, —$OCH_2C(O)NHCH_2CH_2OC(=O)OCH_3$, —P(=O)$(OC_2H_5)_2$, —$SCH_2CH_2COOH$,

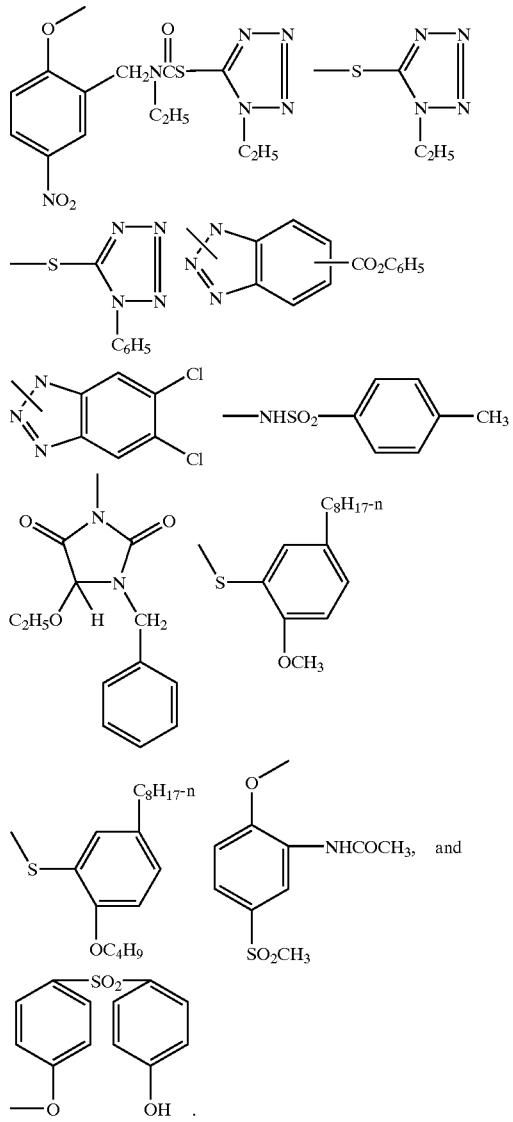

Typically, the coupling-off group is a chlorine atom, hydrogen atom or p-methoxyphenoxy group.

It is essential that the substituent groups be selected so as to adequately ballast the coupler and the resulting dye in the organic solvent in which the coupler is dispersed. The ballasting may be accomplished by providing hydrophobic substituent groups in one or more of the substituent groups. Generally a ballast group is an organic radical of such size and configuration as to confer on the coupler molecule sufficient bulk and aqueous insolubility as to render the coupler substantially nondiffusible from the layer in which it is coated in a photographic element. Thus the combination of substituent are suitably chosen to meet these criteria. To be effective, the ballast will usually contain at least 8 carbon atoms and typically contains 10 to 30 carbon atoms. Suitable ballasting may also be accomplished by providing a plurality of groups which in combination meet these criteria. In the preferred embodiments of the invention $R_1$ in formula (I) is a small alkyl group or hydrogen. Therefore, in these embodiments the ballast would be primarily located as part of the other groups. Furthermore, even if the coupling-off group Z contains a ballast it is often necessary to ballast the other substituents as well, since Z is eliminated from the molecule upon coupling- thus, the ballast is most advantageously provided as part of groups other than Z.

The following examples further illustrate preferred coupler of the invention. It is not to be construed that the present invention is limited to these examples.

C-1

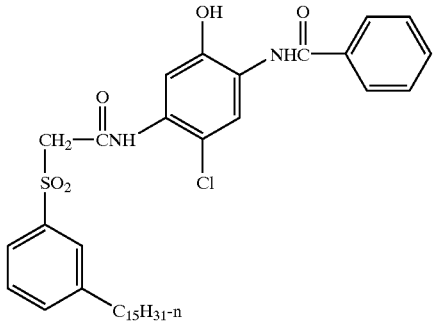

C-2

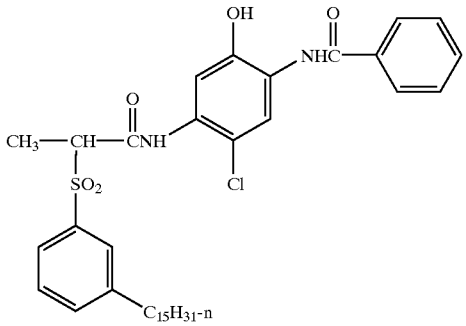

C-3

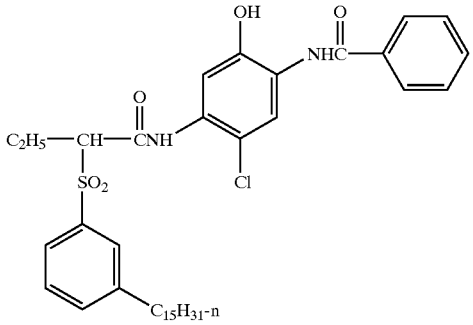

C-4

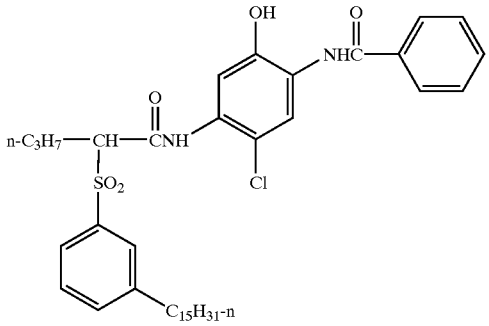

-continued

C-5

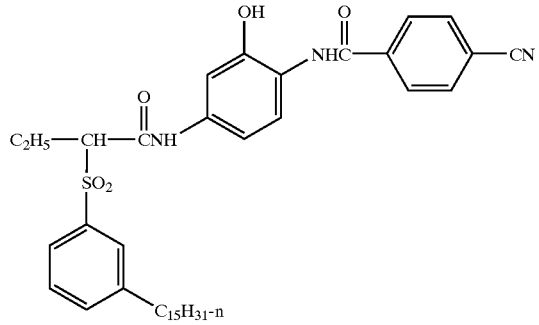

C-6

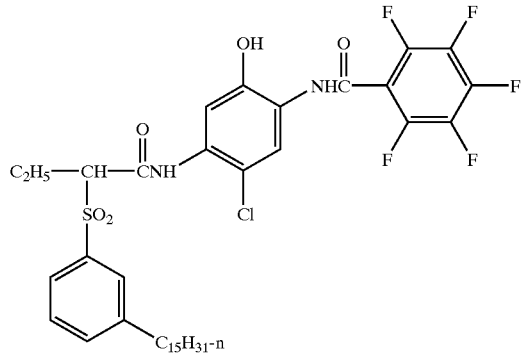

C-7

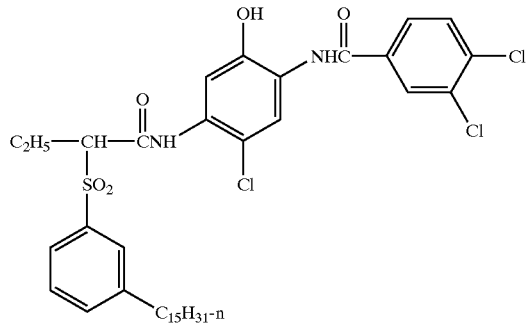

C-8

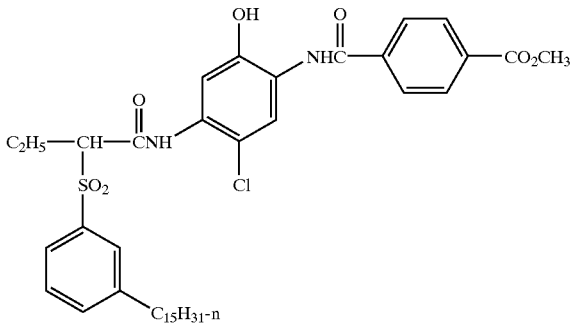

-continued
C-9
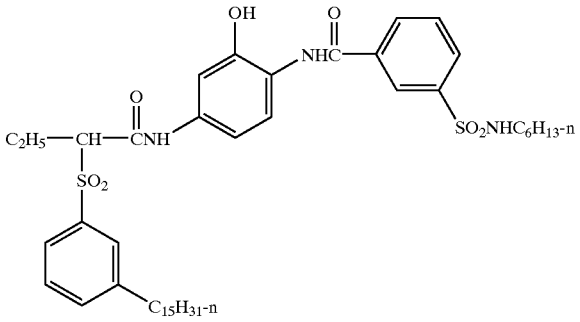
C-10
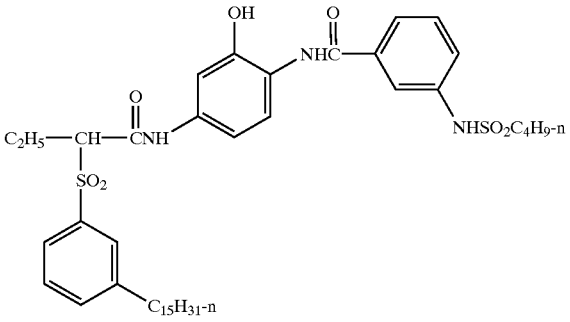
C-11
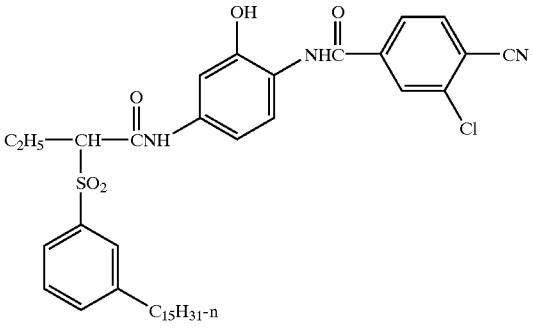
C-12
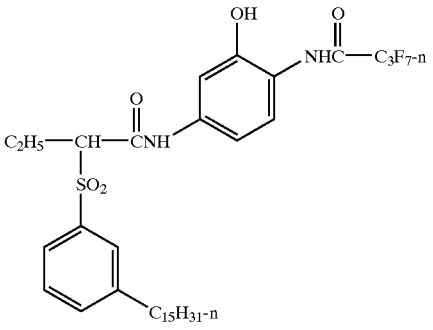
-continued
C-13
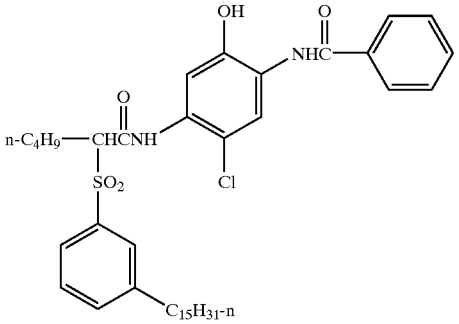
C-14
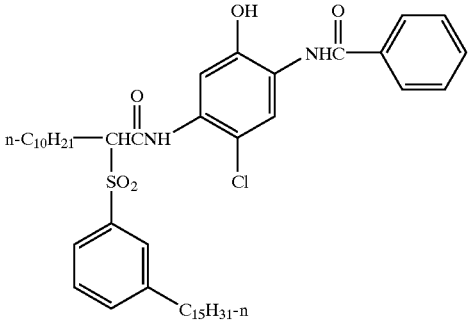
C-15
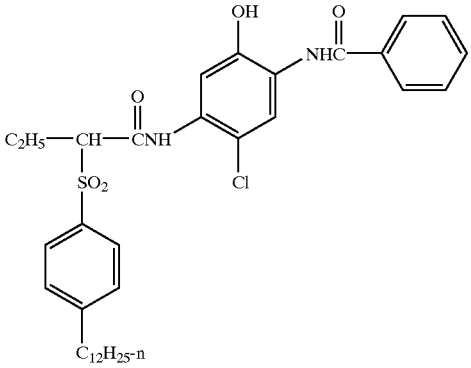
C-16
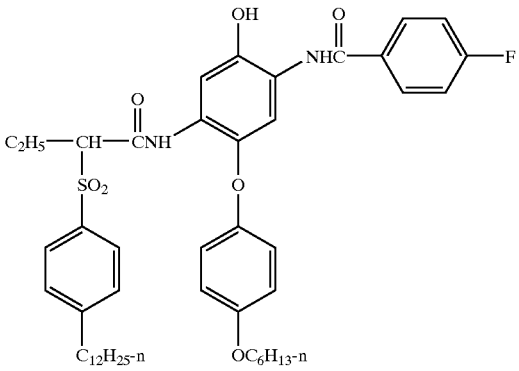

-continued
C-17
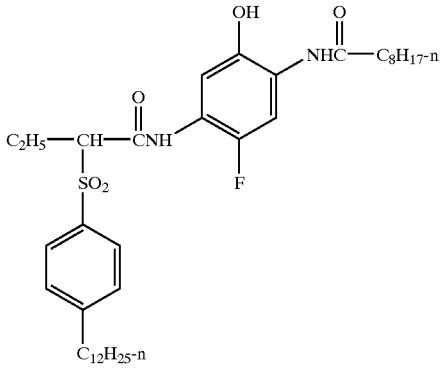
C-18
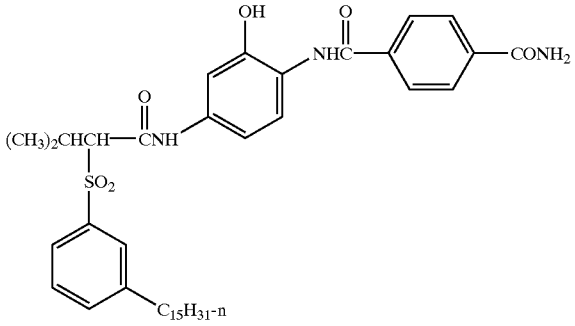
C-19
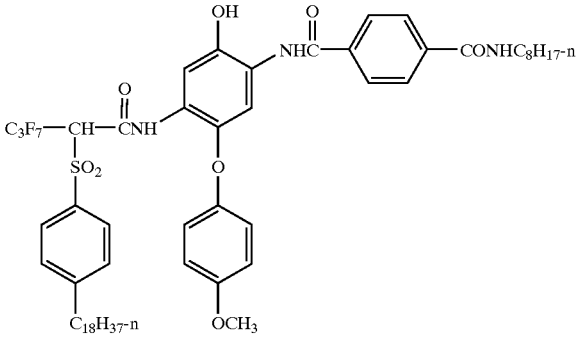
C-20
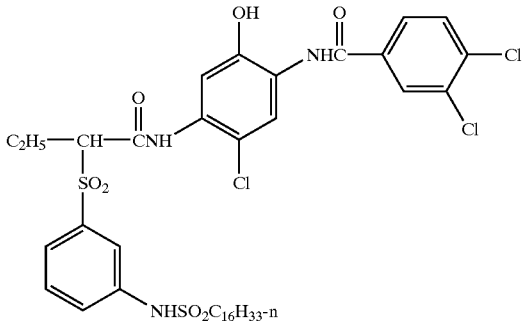
-continued
C-21
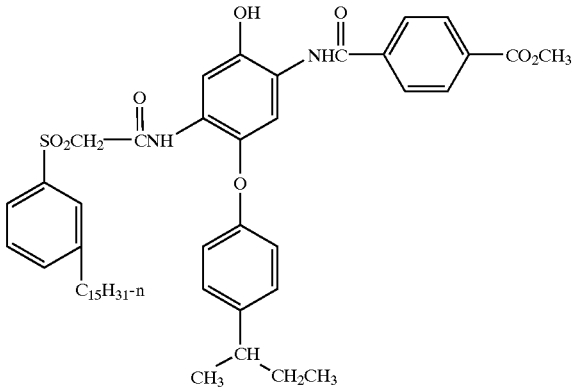
C-22
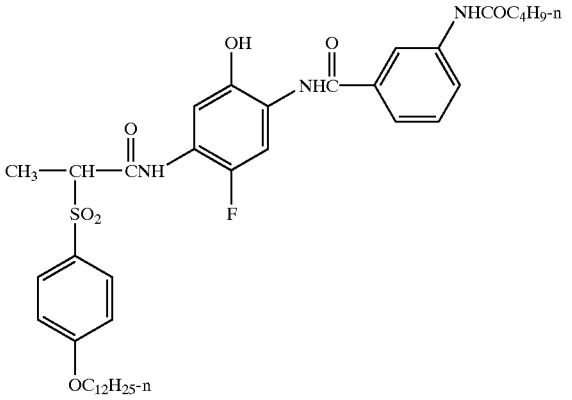
C-23
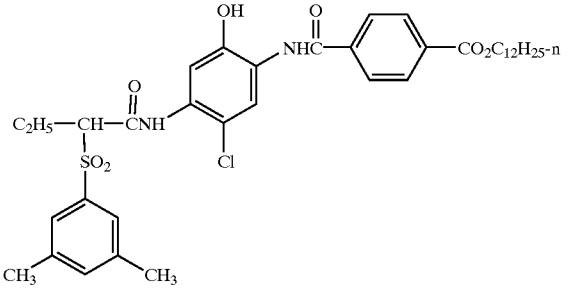
C-24
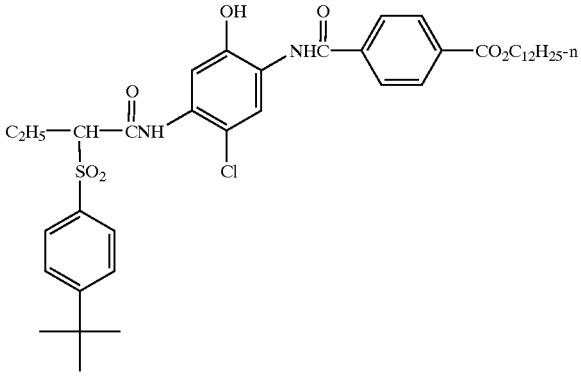

-continued
C-25
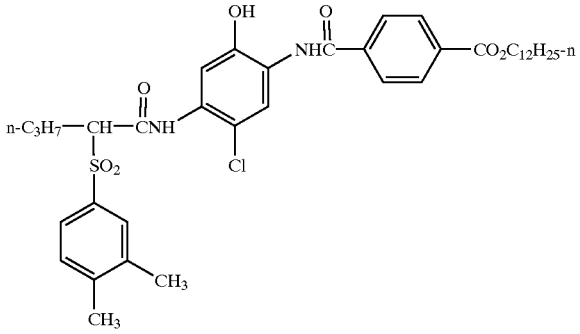
C-26
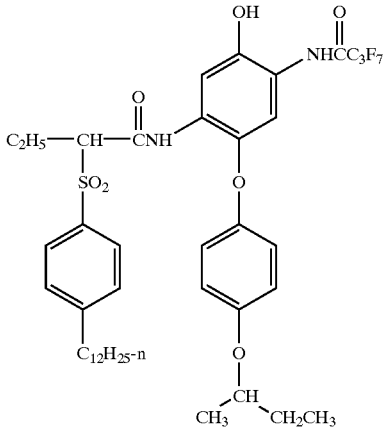
C-27
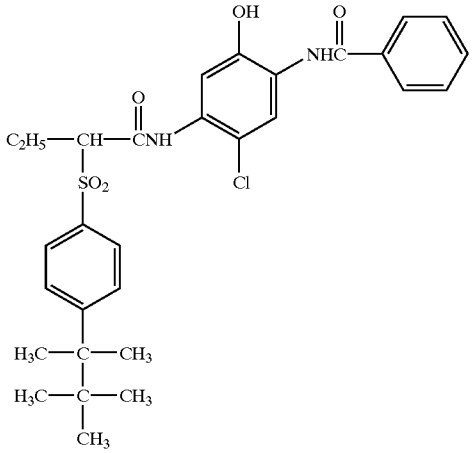
C-28
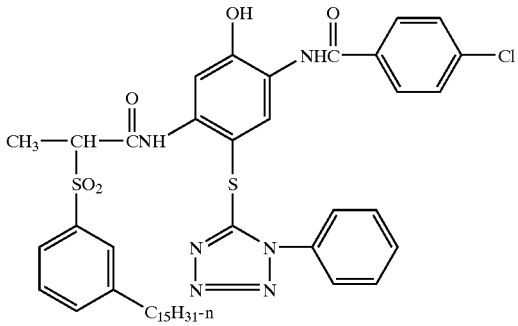
-continued
C-29
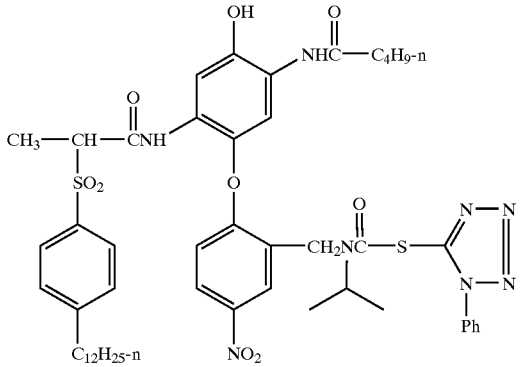
C-30
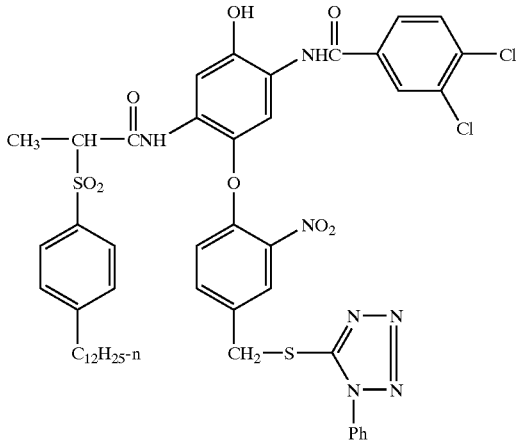
C-31
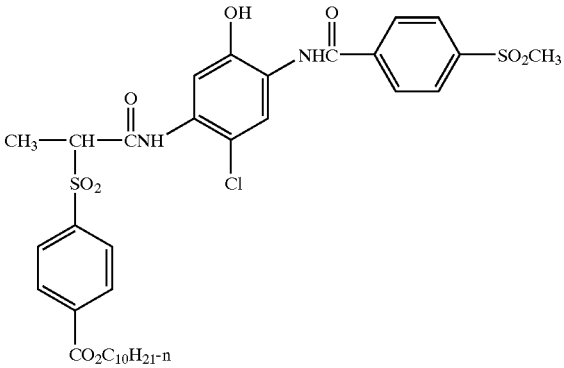
C-32
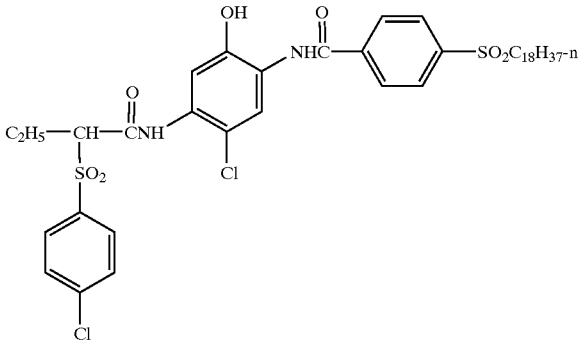

C-33
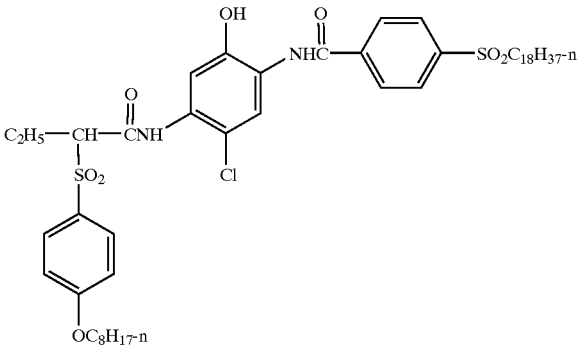
C-34
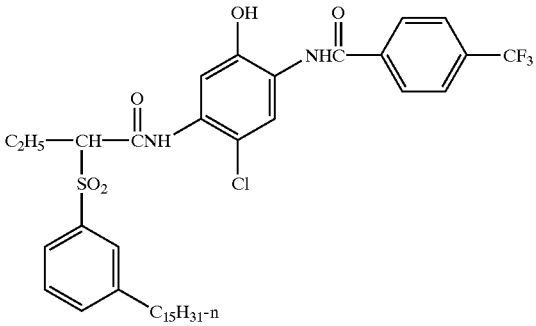
C-35
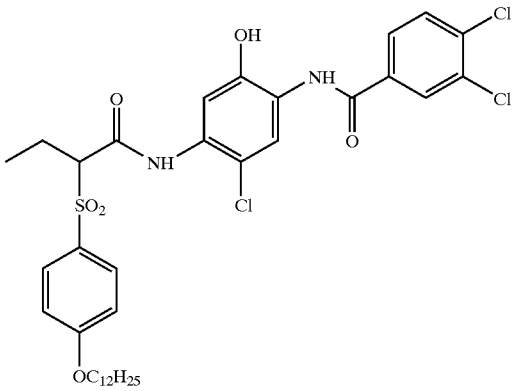
C-36
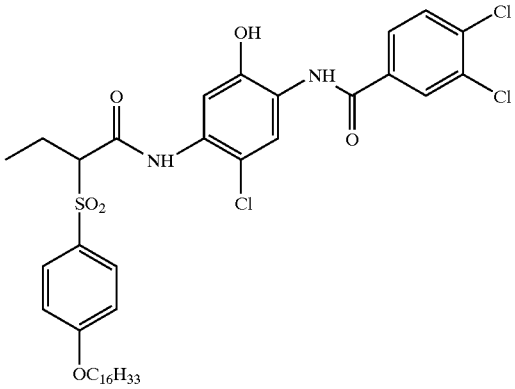
C-37
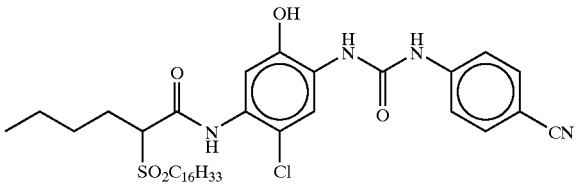
C-38
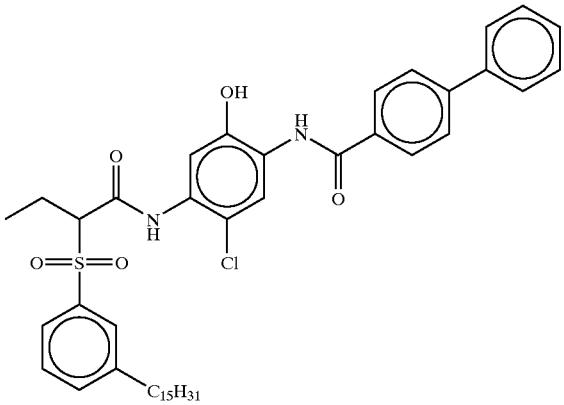
C-39
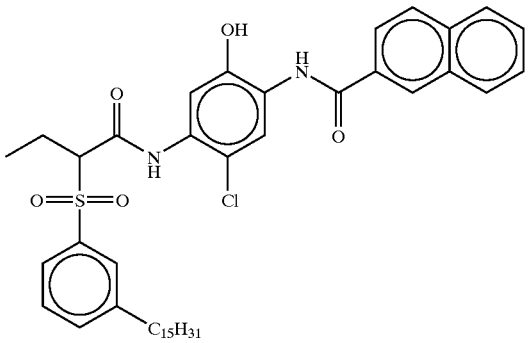
C-40
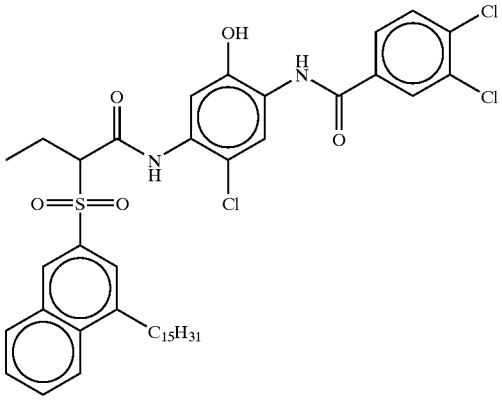

-continued

C-41

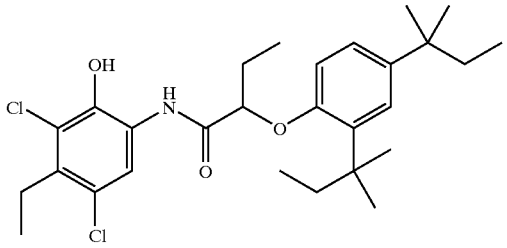

Preferred couplers are C-3, C-7, C-35, and C-36 because of their suitably narrow left bandwidths. Coupler C-41 is desirable due to its low cost.

Couplers that form magenta dyes upon reaction with oxidized color developing agent are described in such representative patents and publications as: U.S. Pat. Nos. 2,311,082, 2,343,703, 2,369,489; 2,600,788; 2,908,573; 3,062,653; 3,152,896; 3,519,429; 3,758,309; and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo[5,1-c]-1,2,4-triazole couplers are described in U.K. Patent Nos. 1,247,493; 1,252,418; 1,398,979, U.S. Patent Nos. 4,443,536; 4,514,490; 4,540,654, 4,590,153; 4,665,015; 4,822,730; 4,945,034; 5,017,465; and 5,023,170. Examples of 1H-pyrazolo[1,5-b]-1,2,4-triazoles can be found in European Patent applications 176,804; 177,765, U.S Pat. Nos. 4,659,652; 5,066,575; and 5,250,400.

Typical pyrazoloazole and pyrazolone couplers are represented by the following formulas:

MAGENTA-1

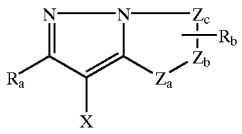

MAGENTA-2

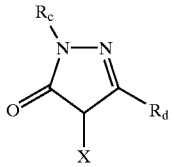

wherein $R_a$ and $R_b$ independently represent H or a substituent; $R_c$ is a substituent (preferably an aryl group), $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Specific examples of such couplers are:

M-1

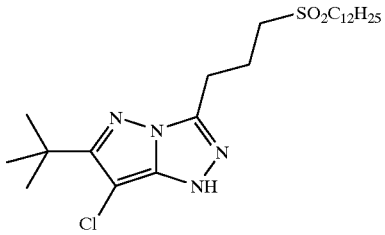

M-2

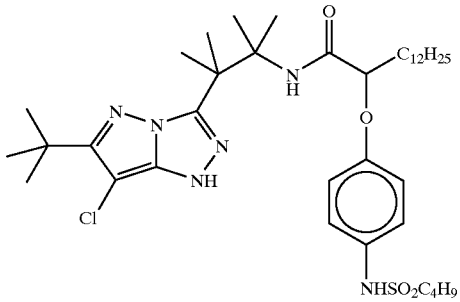

M-3

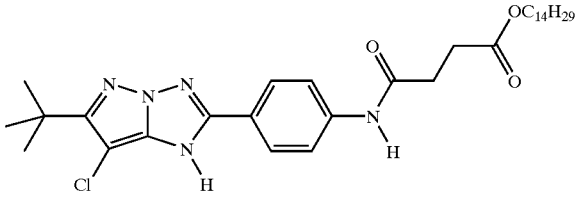

M-4

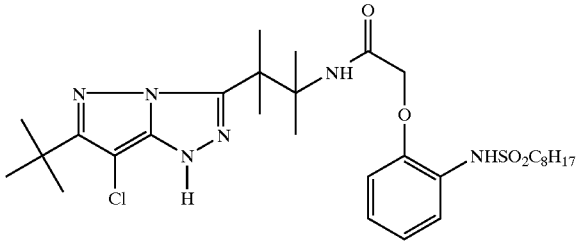

M-5

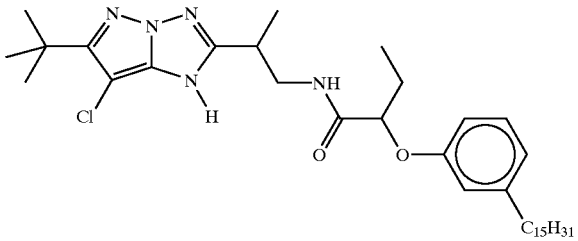

Of these, M-3 is especially preferred due to its inherent light stability, and M-4 is especially preferred due to its broad color gamut when combined with the other preferred image couplers of this invention.

Couplers that form yellow dyes upon reaction with oxidized color developing agent are described in such representative patents and publications as: U.S. Pat. Nos. 2,298,443; 2,407,210; 2,875,057; 3,048,194; 3,265,506; 3,447,928; 3,960,570; 4,022,620; 4,443,536; 4,910,126; and 5,340,703 and "Farbkuppler-eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803. For improved color reproduction, couplers which give yellow dyes that cut off sharply on the long wavelength side are particularly preferred (for example, see U.S. Pat. No. 5,360,713).

Typical preferred yellow couplers are represented by the following formulas:

YELLOW-1

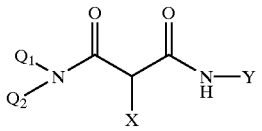

YELLOW-2

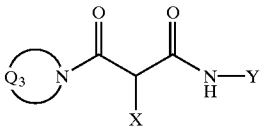

YELLOW-3

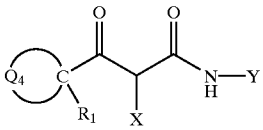

YELLOW-4

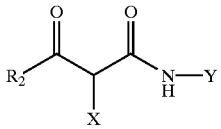

wherein $R_1$, $R_2$, $Q_1$ and $Q_2$ each represents a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group, and $R_2$ represents an aryl or tertiary alkyl group.

Preferred yellow couplers can be of the following general structures

Y-1

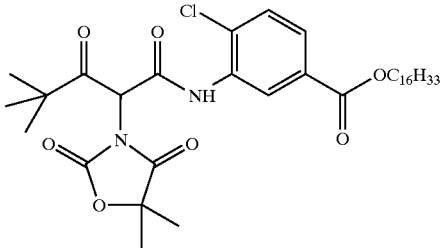

-continued

Y-2

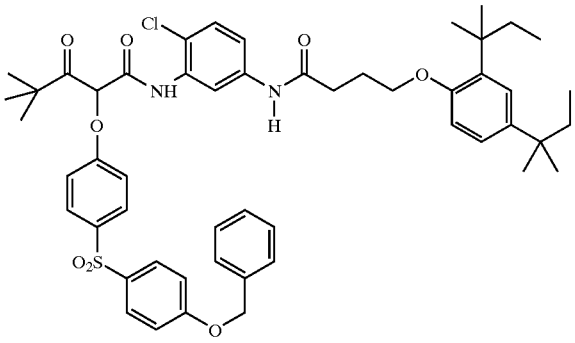

Y-3

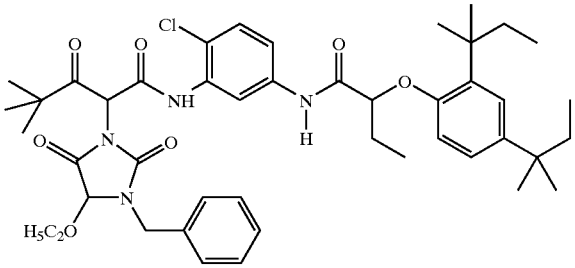

Y-4

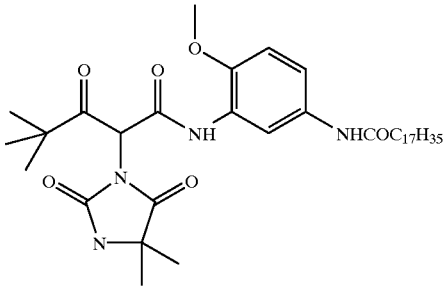

Y-5

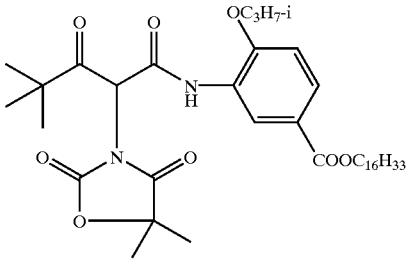

Y-6

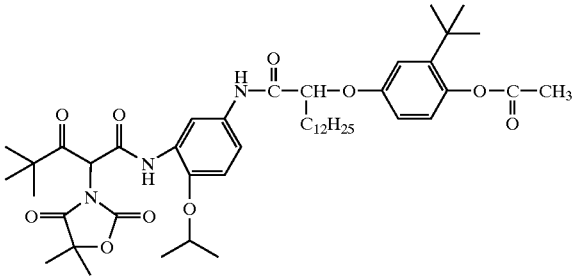

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine, nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecyl amino, ethoxycarbonylamino, phenoxycarbonyl amino, benzyloxycarbonylamino, hexadecyloxycarbonylamino, 2,4-di-t-butylphenoxycarbonyl amino, phenylcarbonylaamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylbexylsulfonyl, dodecylsulfonyl, hexadecylsulfonyl, phenylsulfonyl, 4-nonylphenylsulfonyl, andp-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, andp-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amino, such as phenylanilino, 2-chloroanilino, diethylamino, dodecylamino; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

Silver halide imaging layers substantially free of image dye stabilizers are preferred. Silver halide image dye stabilizers are utilized to reduce image fading. Image dye stabilizers are however expensive and not generally required for silver halide images attached to packages of the invention since the shelf life of a package tends to be less than one calendar year. Silver halide imaging layers substantially free of image dye stabilizers would be lower in cost and have acceptable image quality for images attached to packages.

Scavengers are typically utilized to protect from the growth of fog in storage. One example of a preferred scavenger is 2,5-Di-tert-octyl hydroquinone.

Examples of solvents that may be used in the invention include the following:

| | |
|---|---|
| Tritolyl phosphate | S-1 |
| Dibutyl phthalate | S-2 |
| Diundecyl phthalate | S-3 |
| N,N-Diethyldodecanamide | S-4 |
| N,N-Dibuty1dodecanamide | S-5 |
| Tris(2-ethylhexyl)phosphate | S-6 |
| Acetyl tributyl citrate | S-7 |
| 2,4-Di-tert-pentylphenol | S-8 |
| 2-(2-Butoxyethoxy)ethyl acetate | S-9 |
| 1,4-Cyclohexyldimethylene bis(2-ethylhexanoate) | S-10 |

Silver halide imaging layers substantially free of ultraviolet (UV) absorbing dyes are preferred. UV absorbers are typically utilized to reduce image fading. UV absorbing dyes are however expensive and not generally required for silver halide images attached to packages of the invention since the shelf life of a package tends to be less than one calendar year. For longer life, it is common to incorporate an ultraviolet (UV) light absorbing compound in the environmental protection layer. The optional application of this environmental protection layer allows the customer to have a media that is customizable to the application. For example, a product, which moves quickly off the shelves, may not need extra stabilization, therefore the lowest cost media would be desired. On the other hand, some packages may be expected to last for longer periods of time, especially keepsake items. For these applications, UV stabilization could be added to a post photographic process application of an environmental protection layer.

The dispersions used in photographic elements may also include ultraviolet (UV) stabilizers and so called liquid UV stabilizers such as described in U.S. Pat. Nos. 4,992,358; 4,975,360; and 4,587,346. Examples of UV stabilizers are shown below.

UV-1

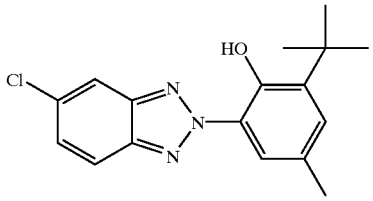

UV-2

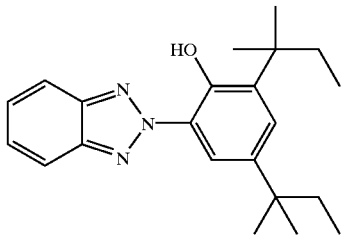

UV-3

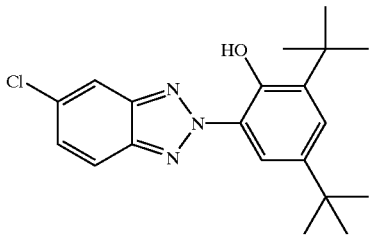

UV-4

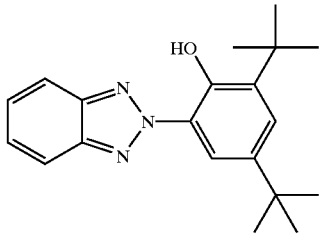

-continued

UV-5

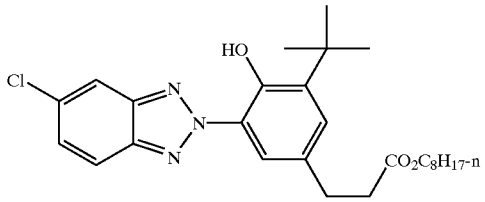

UV-6

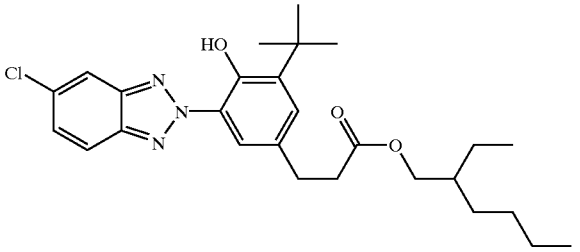

UV-7

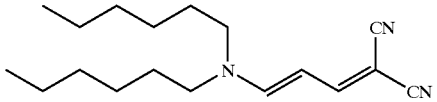

UV-8

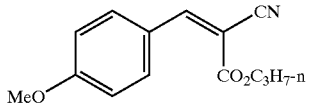

The aqueous phase may include surfactants. Surfactant may be cationic, anionic, zwitterionic or non-ionic. Useful surfactants include, but are not limited to, the following.

SF-1

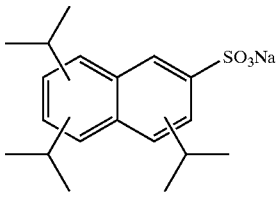

SF-2

$CF_3{\bullet}(CF_2)_7{\bullet}SO_3Na$

SF-3

$CH_3{\bullet}(CH_2)_n{\bullet}SO_3Na$,
n = 12–14

SF-4

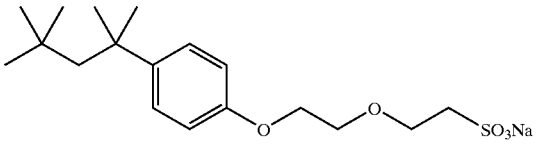

SF-5

$CH_3{\bullet}(CH_2)_{11}{\bullet}OSO_3Na$

SF-6

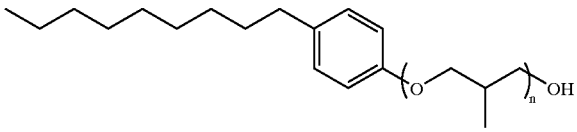

n = ca. 10

-continued

SF-7

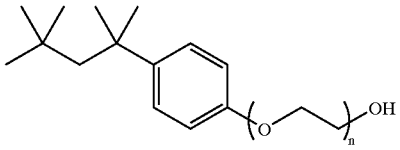

n = ca. 40

SF-8

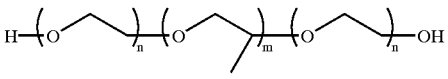

n = ca. 6, m = ca. 2

SF-9

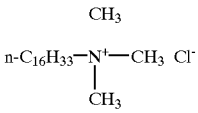

SF-10

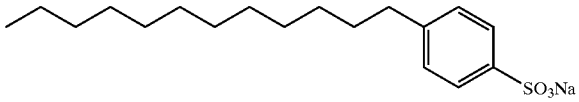

SF-11

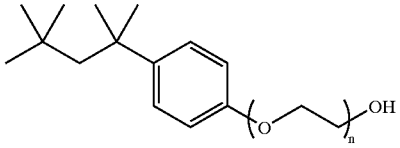

n = ca. 10

SF-12

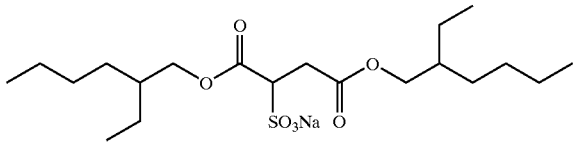

Further, it is contemplated to stabilize photographic dispersions prone to particle growth through the use of hydrophobic, photographically inert compounds such as disclosed by Zengerle et al in U.S. Pat. No. 5,468,604.

In a preferred embodiment the invention employs recording elements which are constructed to contain at least three silver halide emulsion layer units. A suitable full color, multilayer format for a recording element used in the invention is represented by Structure I.

| STRUCTURE I |
|---|
| Protective overcoat(s) |
| Red-sensitized |
| cyan dye image-forming silver halide emulsion unit |
| Interlayer |
| Green-sensitized |
| magenta dye image-forming silver halide emulsion unit |
| Interlayer |
| Blue-sensitized |
| yellow dye image-forming silver halide emulsion unit |
| ///// Support ///// |

wherein the red-sensitized, cyan dye image-forming silver halide emulsion unit is situated nearest the support; next in order is the green-sensitized, magenta dye image-forming unit, followed by the uppermost blue-sensitized, yellow dye image-forming unit. The image-forming units are separated from each other by hydrophilic colloid interlayers containing an oxidized developing agent scavenger to prevent color contamination. Silver halide emulsions satisfying the grain and gelatino-peptizer requirements described above can be present in any one or combination of the emulsion layer units. Additional useful multicolor, multilayer formats for an element of the invention include structures as described in U.S. Pat. Nos. 5,783,373 and 5,948,601. Each of such structures in accordance with the invention preferably would contain at least three silver halide emulsions comprised of high chloride grains having at least 50 percent of their surface area bounded by {100} crystal faces and containing dopants from classes (i) and (ii), as described above. Preferably each of the emulsion layer units contains emulsion satisfying these criteria.

Conventional features that can be incorporated into multilayer (and particularly multicolor) recording elements contemplated for use in the method of the invention are illustrated by *Research Disclosure*, Item 38957, cited above:

XI. Layers and layer arrangements

XII. Features applicable only to color negative

XIII. Features applicable only to color positive

B. Color reversal

C. Color positives derived from color negatives

XIV. Scan facilitating features.

The recording elements comprising the radiation sensitive high chloride emulsion layers according to this invention can be conventionally optically printed, or in accordance with a particular embodiment of the invention can be image-wise exposed in a pixel-by-pixel mode using suitable high energy radiation sources typically employed in electronic printing methods. Suitable actinic forms of energy encompass the ultraviolet, visible and infrared regions of the electromagnetic spectrum as well as electron-beam radiation and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892. Suitable exposures include those up to 2000 nm, preferably up to 1500 nm. Suitable light emitting diodes and commercially available laser sources are known and commercially available. Imagewise exposures at ambient, elevated or reduced temperatures and/or pressures can be employed within the useful response range of the recording element determined by conventional sensitometric techniques, as illustrated by T. H. James, *The Theory of the Photographic Process*, 4th Ed., Macmillan, 1977, Chapters 4, 6, 17, 18 and 23.

The ability to produce an image containing any particular color is limited by the color gamut of the system and materials used to produce the image. Thus, the range of colors available for image reproduction is limited by the color gamut that the system and materials can produce. The coupler sets which have been traditionally employed in silver halide color imaging have not provided the range of gamut desired for modem digital imaging, especially for so-called 'spot colors', or 'HiFi colors'.

It is therefore a problem to be solved by providing a coupler set which provides a further increase in color gamut compared to coupler sets comprised of cyan, magenta and yellow dye forming couplers by further incorporating red dye and/or blue dye forming couplers, in accordance with U.S. Pat. No. 6,180,328 and US Pat. No. 6,197,489. These additional couplers would be employed in their own separate imaging layers, each having its own unique spectral sensitization and thus each requiring a unique exposure appropriate for that sensitizing dye. This is only possible with digital imaging, where the digitized image information is rendered into the appropriate number of channels which are matched to the output device and the imaging media colorants.

Therefore, in addition to the traditional cyan, magenta, and yellow imaging layers, it would be desirable, from an increased color gamut point of view, to add a fourth image dye-forming layer comprising a coupler wherein a "red" dye formed by that coupler has a CIELAB $h_{ab}$ hue angle in the range of from not less than 355° to not more than 75°, or a coupler wherein a "blue" dye formed by that coupler has a CIELAB $h_{ab}$ hue angle in the range of from not less than 225° to not more than 310°. Also, a fifth image dye-forming layer could be added such that a "blue" dye formed by the coupler in the fourth layer has a hue angle in the range of from not less than 225° to not more than 310°, and a "red" dye formed by the coupler in the fifth layer has a hue angle in the range of from not less than 355° to not more than 75°.

As noted above, the red coupler forms a dye that has a hue-angle, $h_{ab}$, of not less than 355° and not more than 75°, and the blue coupler forms a dye that has a hue-angle from 225 to 310°. The dyes are formed upon reaction of the coupler with a suitable developing agent such as a p-phenylenediamine color developing agent. Suitably the agent is CD-3 as disclosed for use in the RA-4 process of Eastman Kodak Company as described in the British Journal of Photography Annual of 1988, pp 198–199.

The hue angle of the 'red' dye is from not less than 355° to not more than 75°, suitably from 5–75°, and preferably from 15–75°, and in this five member coupler combination, desirably from 25–45°.

Examples of 'red' dyes useful in the invention are:

IR-1

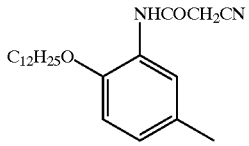

IR-2

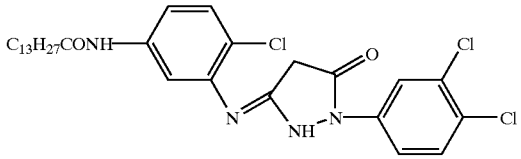

IR-3

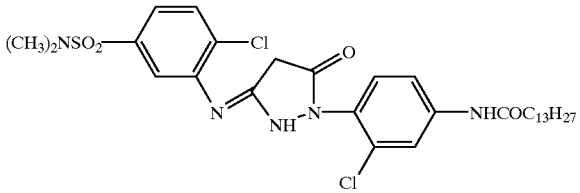

-continued

IR-4

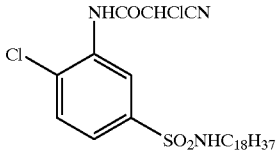

IR-5

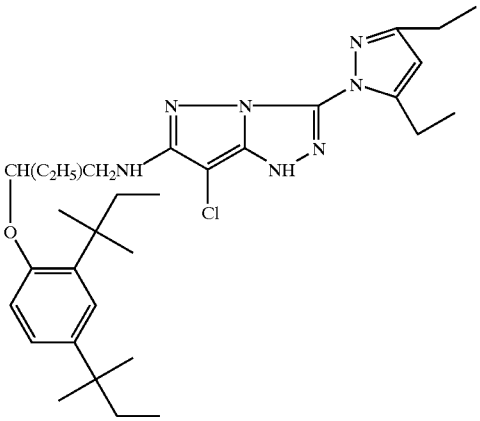

IR-6

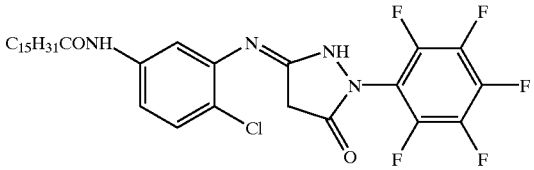

IR-7

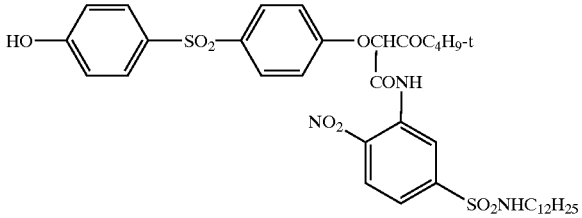

IR-8

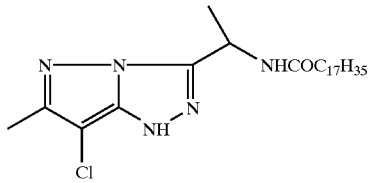

IR-9

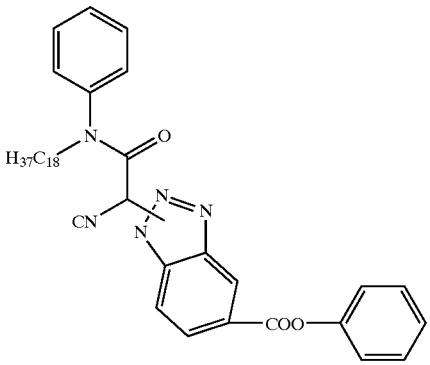

The hue angle of the 'blue' dye is from 225 to 310°, suitably from 228–305°, and preferably from 230–290°. Examples of 'blue' dyes useful in the invention are:

IB-1

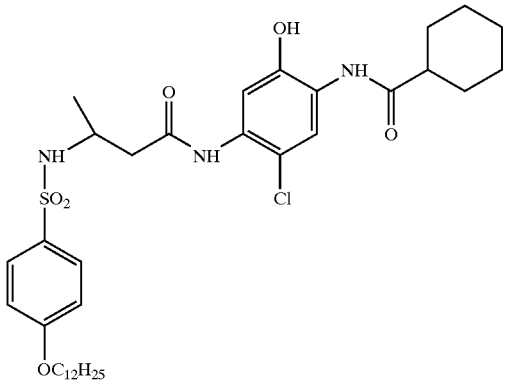

IB-2

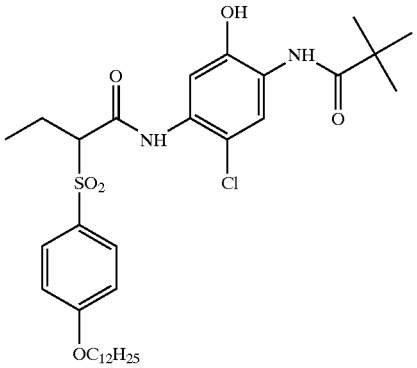

IB-3

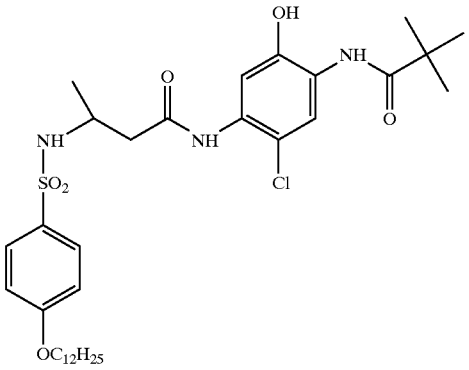

IB-4

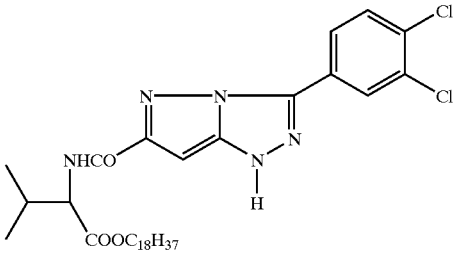

-continued

IB-5

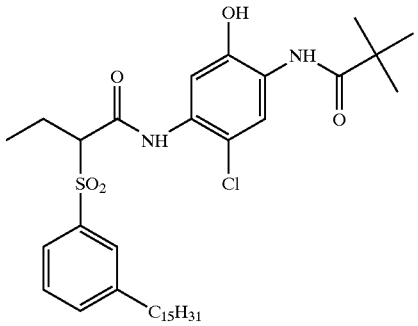

IB-6

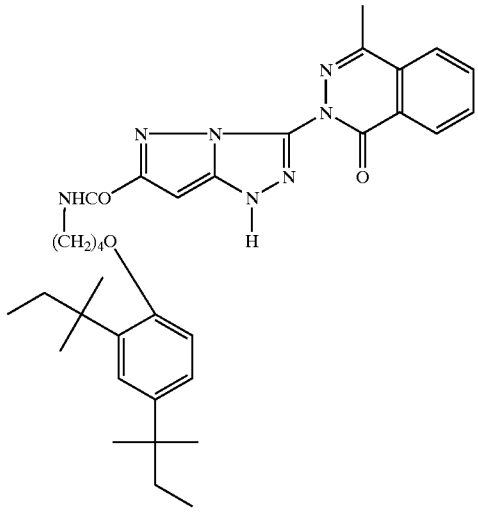

Since the effect of the 'red' and 'blue' dye-forming couplers of the invention is optical rather than chemical, the invention is not limited to a particular compound or class of compounds. Further, more than one coupler of a particular color may be employed in combination which together produce a composite density curve which may satisfy the requirements of the invention.

It has been observed that anionic $[MX_xY_yL_z]$ hexacoordination complexes, where M is a group 8 or 9 metal (preferably iron, ruthenium or iridium), X is halide or pseudohalide (preferably Cl, Br or CN) x is 3 to 5, Y is $H_2O$, y is 0 or 1, L is a C—C, H—C or C—N—H organic ligand, and Z is 1 or 2, are surprisingly effective in reducing high intensity reciprocity failure (HIRF), low intensity reciprocity failure (LIRF) and thermal sensitivity variance and in in improving latent image keeping (LIK). As herein employed HIRF is a measure of the variance of photographic properties for equal exposures, but with exposure times ranging from $10^{-1}$ to $10^{-6}$ second. LIRF is a measure of the varinance of photographic properties for equal exposures, but with exposure times ranging from $10^{-1}$ to 100 seconds. Although these advantages can be generally compatible with face centered cubic lattice grain structures, the most striking improvements have been observed in high (>50 mole %, preferably >90 mole %) chloride emulsions. Preferred C—C, H—C or C—N—H organic ligands are aromatic heterocycles of the type described in U.S. Pat. No. 5,462,849. The most effective C—C, H—C or C—N—H organic ligands are azoles and azines, either unsustituted or containing alkyl, alkoxy or halide substituents, where the alkyl moieties contain from 1 to 8 carbon atoms. Particularly preferred azoles and azines include thiazoles, thiazolines and pyrazines.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$ and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100 $\mu$seconds, often up to 10 $\mu$seconds, and frequently up to only 0.5, seconds. Single or multiple exposures of each pixel are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed 107 pixels/cm and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer*, Journal of Imaging Technology, Vol. 14, No. 3, June 1988. As previously indicated herein, a description of some of the details of conventional electronic printing methods comprising scanning a recording element with high energy beams such as light emitting diodes or laser beams, are set forth in Hioki U.S. Pat. No. 5,126,235, European Patent Applications 479 167 A1 and 502 508 A1.

Once imagewise exposed, the recording elements can be processed in any convenient conventional manner to obtain a viewable image. Such processing is illustrated by *Research Disclosure*, Item 38957, cited above:

XVIII. Chemical development systems

XIX. Development

XX. Desilvering, washing, rinsing and stabilizing

In addition, a useful developer for the inventive material is a homogeneous, single part developing agent. The homogeneous, single-part color developing concentrate is prepared using a critical sequence of steps:

In the first step, an aqueous solution of a suitable color developing agent is prepared. This color developing agent is generally in the form of a sulfate salt. Other components of the solution can include an antioxidant for the color developing agent, a suitable number of alkali metal ions (in an at least stoichiometric proportion to the sulfate ions) provided by an alkali metal base, and a photographically inactive water-miscible or water-soluble hydroxy-containing organic solvent. This solvent is present in the final concentrate at a concentration such that the weight ratio of water to the organic solvent is from about 15:85 to about 50:50.

In this environment, especially at high alkalinity, alkali metal ions and sulfate ions form a sulfate salt that is precipitated in the presence of the hydroxy-containing organic solvent. The precipitated sulfate salt can then be readily removed using any suitable liquid/solid phase separation technique (including filtration, centrifugation or decantation). If the antioxidant is a liquid organic compound, two phases may be formed and the precipitate may be removed by discarding the aqueous phase.

The color developing concentrates of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure*, publication 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Preferred coloi developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In order to protect the color developing agents from oxidation, one or more antioxidants are generally included in the color developing compositions. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones. Mixtures of compounds from the same or different classes of antioxidants can also be used if desired.

Especially useful antioxidants are hydroxylamine derivatives as described for example, in U.S. Pat. Nos. 4,892,804, 4,876,174; 5,354,646; 5,660,974, and 5,646,327 (Burns et al). Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

More preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al) as having the structure I:

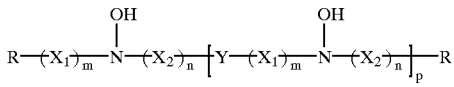

wherein R is hydrogen, a substituted or unsubstituted alkyl group of 1 to 10 carbon atoms, a substituted or unsubstituted hydroxyalky group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is —$CR_2(OH)CHR_1$— and $X_2$ is —$CHR_1CR_2(OH)$— wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure I, m, n and p are independently 0 or 1. Preferably, each of m and n is 1, and p is 0.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

The colorants can be incorporated into the imaging element by direct addition of the colorant to a coating melt by mixing the colorant with an aqueous medium containing gelatin (or other hydrophilic colloid) at a temperature of 40° C. or higher. The colorant can also be mixed with an aqueous solution of a water-soluble or water-dispersible surfactant or polymer, and passing the premix through a mill until the desired particle size is obtained. The mill can be any high energy device such as a colloid mill, high pressure homogenizer, or the like.

The preferred color of the pigment is blue as a blue pigment incorporated into a gelatin layer offsets the native yellowness of the gelatin yielding a neutral background for the image layers.

Suitable pigments used in this invention can be any inorganic or organic, colored materials which are practically insoluble in the medium in which they are incorporated. The preferred pigments are organic, and are those described in *Industrial Organic Pigments: Production, Properties, Applications* by W. Herbst and K. Hunger, 1993, Wiley Publishers. These include: Azo Pigments such as monoazo yellow and orange, diazo, naphthol, naphthol reds, azo lakes, benzimidazolone, disazo condensation, metal complex, isoindolinone and isoindoline, Polycyclic Pigments such as phthalocyanine, quinacridone, perylene, perinone, diketopyrrolo pyrrole and thioindigo, and Anthrquinone Pigments such as anthrapyrimidine, flavanthrone, pyranthrone, anthanthrone, dioxazine, triarylcarbodium and quinophthalone.

The most preferred pigments are the anthraquinones such as Pigment Blue 60, phthalocyanines such as Pigment Blue 15, 15:1, 15:3, 15:4 and 15:6, and quinacridones such as Pigment Red 122, as listed in *NPIRI Raw Materials Data Handbook, Vol. 4, Pigments*, 1983, National Printing Research Institute. These pigments have a dye hue sufficient to overcome the native yellowness of the gelatin imaging layer and are easily dispersed in a aqueous solution.

An aqueous dispersion of the pigments is preferred because the preferred pigments are insoluble in most, if not all, organic solvents, and therefore a high quality dispersion is not likely in a solvent system. In fact, the only solvent that will dissolve preferred pigments PR-122 and PB-15 is concentrated sulfuric acid, which is not an organic solvent. Preferred pigments of the invention are by nature, insoluble, crystalline solids, which is the most thermodynamically stable form that they can assume. In an oil and water dispersion, they would be in the form of an amorphous solid, which is thermodynamically unstable. Therefore, one would have to worry about the pigment eventually converting to the crystalline form with age. We might as well start with a crystalline solid and not worry about preventing the phase transition. Another reason to avoid solvent pigment dispersions is that the high boiling solvent is not removed with evaporation, and it could cause unwanted interactions in the coating melt such as ripening of DOH dispersion particles, or equilibration with other layers, if it was used in the coating. The use of solid particle dispersion avoids organic solvents altogether.

In the preferred embodiment, the colorant is dispersed in the binder in the form of a solid particle dispersion. Such dispersions are formed by first mixing the colorant with an aqueous solution containing a water-soluble or water-dispersible surfactant or polymer to form a coarse aqueous premix, and adding the premix to a mill. The amount of water-soluble or water-dispersible surfactant or polymer can vary over a wide range, but is generally in the range of 0.01% to 100% by weight of polymer, preferably about 0.3% to about 60%, and more preferably 0.5% to 50%, the percentages being by weight of polymer, based on the weight of the colorant useful in imaging.

The mill can be for example, a ball mill, media mill, attritor mill, vibratory mill, or the like. The mill is charged with the appropriate milling media such as, for example, beads of silica, silicon nitride, sand, zirconium oxide, yttria-stabilized zirconium oxide, alumina, titanium, glass, polystyrene, etc. The bead sizes typically range from 0.25 to 3.0 mm in diameter, but smaller media can be used if desired. The premix is milled until the desired particle size range is reached.

The solid colorant particles are subjected to repeated collisions with the milling media, resulting in crystal fracture, deagglomeration, and consequent particle size reduction. The solid particle dispersions of the colorant should have a final average particle size of less than 1 $\mu$m, preferably less than 0.1 micrometers, and most preferably between 0.01 and 0.1 $\mu$m. Most preferably, the solid colorant particles are of sub-micrometer average size. Solid particle size between 0.01 and 0.1 provides the best pigment utilization and had a reduction in unwanted light absorption compared to pigments with a particle size greater than 1.2 $\mu$m.

The preferred gelatin to pigment ratio in any gelatin layer is between 65,000:1 to 195,000:1. This gelatin to pigment ratio is preferred as this range provides the necessary color correction to typical photographic imaging layers and typical ink jet dye receiving layers to provide a perceptually preferred neutral background in the image. The preferred coverage of pigment in the gelatin layer is between 0.006 grams/$m^2$ and 0.020 grams/$r^2$. Coverages less than 0.006 granm/$m^2$ are not sufficient to provide proper correction of the color and coverages greater than 0.025 grams/$M^2$ yield a density minimum that has been found to be objectionable by consumers.

Surfactants, polymers, and other additional conventional addenda may also be used in the dispersing process described herein in accordance with prior art solid particle dispersing procedures. Such surfactants, polymers and other addenda are disclosed in U.S. Pat. Nos. 5,468,598, 5,300, 394, 5,278,037; 4,006,025; 4,924,916; 4,294,917; 4,940, 654; 4,950,586; 4,927,744, 5,279,931; 5,158,863; 5,135,844; 5,091,296; 5,089,380; 5,103,640; 4,990,431; 4,970,139; 5,256,527; 5,089,380; 5,103,640; 4,990,431; 4,970,139; 5,256,527; 5,015,564; 5,008,179; 4,957,857; and 2,870,012, and British Patent specifications Nos. 1,570,362 and 1,131,179 in the dispersing process of the colorants.

Additional surfactants or other water soluble polymers may be added after formation of the colorant dispersion, before or after subsequent addition of the colorant dispersion to an aqueous coating medium for coating onto an imaging element support. The aqueous medium preferably contains other compounds such as stabilizers and dispersants, for example, additional anionic, nonionic, zwitterionic, or cationic surfactants, and water soluble binders such as gelatin as is well known in the imaging art. The aqueous coating medium may further contain other dispersions or emulsions of compounds useful in imaging.

EXAMPLES

The following examples illustrate the practice of this invention. They are not intended to be exhaustive of all possible variations of the invention. Parts and percentages are by weight unless otherwise indicated.

A silver halide pressure sensitive packaging label is created by applying a light sensitive silver halide imaging layers to a pressure sensitive label substrate. The photographic label substrate consists of a flexible biaxially oriented polypropylene pragmatic sheet backside coated with a pressure sensitive adhesive that is adhered to a laminated black coated paper carrier sheet. The light sensitive silver halide imaging layers are a yellow, magenta, and cyan coupler system capable of accurate reproduction of flesh tone. After processing the image, the photographic label can be coated with an environmental protection layer to protect the delicate silver halide imaging layers from environmental solvents. This example demonstrates how to create a photographic label with excellent imaging performance and minimal cost.

Biaxially Oriented Polyolefin Pragmatic Sheet Used in the Example:

A composite sheet polyolefin sheet (density=0.7 g/cc) consists of an oriented microvoided polypropylene core and a top skin layer consisting of polyethylene and a blue pigment. Additionally a second layer of polypropylene is between the microvoided layer and the top polyethylene skin layer. The silver halide imaging layers are applied to the blue tinted polyethylene skin layer.

Pressure Sensitive Adhesive Used in the Example:

Permanent solvent based acrylic adhesive 12 $\mu$m thick

Laminated Paper Carrier Sheet Used in the Example:

A laminated paper carrier sheet consists of a cellulose paper core (80 micrometers thick) on to which a biaxially oriented sheet of polypropylene is extrusion laminated to the backside utilizing LDPE resin. The backside oriented polypropylene contains a roughness layer to allow for efficient transport in photographic printing equipment. The roughness layer consists of a mixture of polyethylene and polypropylene immiscible polymers. The topside of the carrier sheet is extrusion coated with LDPE. The cellulose paper contains 8% by weight moisture and 1.4% salt by weight for conductivity. The total thickness of the laminated paper carrier sheet is 128 micrometers, and the stiffness is 80 millinewtons in both the machine and cross directions. The paper carrier sheet is coated with a silicone release coat adjacent to the extruded LDPE layer.

Structure of the Base for the Photographic Packaging Label Material of the Example is as Follows:

| | |
|---|---|
| PLA-1 | Pragmatic Layer A |
| | 4 gauge Polyethylene |
| | Sheppard Blue 125A pigment |
| | Flouropolymer @ 1800 ppm |
| PLB-1 | Pragmatic Layer B |
| | 20 gauge Polypropylene |
| | 12% rutile $TiO_2$ |
| PLC-1 | Pragmatic Layer C |
| | 210 gauge microvoided Polypropylene, density 0.50 g/cc |
| | 5% PBT |
| PLD-1 | Pragmatic Layer D |
| | 20 gauge Polypropylene |
| | 12% rutile $TiO_2$ |
| PLE-1 | Pragmatic Layer E |
| | 5 gauge Polypropylene |
| ADH-1 | Adhesive Layer |
| | Acrylic pressure sensitive adhesive |
| REL-1 | Release Layer |
| | Silicone |
| CLA-1 | Carrier Layer A |
| | 50 gauge low density polyethylene |
| CLB-1 | Carrier Layer B |
| | 300 gauge cellulose paper |
| ANT-1 | Antistatic Layer |
| | NAS 60 |
| CLC-1 | Carrier Layer C |
| | 50 gauge low density polyethylene |
| | SLP 9088 (Exxon Mobil) ethylene plastomer |
| CLD-1 | Carrier Layer D |
| | 70 gauge biaxially oriented polypropylene |

Silver Halide Emulsion Preparation

Silver chloride emulsions used in the photographic examples were chemically and spectrally sensitized as described below. A biocide comprising a mixture of N-methyl-isothiazolone and N-methyl-5-chloro-isthiazolone is added after sensitization.

Blue Sensitive Emulsion

EB-1: A high chloride silver halide emulsion is precipitated by adding approximately equimolar silver nitrate and sodium chloride solutions into a well-stilTed reactor containing glutaryldiaminophenyldisulfide, gelatin peptizer, and thioether ripener. Cesium pentachloronitrosylosmate(II) dopant is added during the silver halide grain formation for most of the precipitation, followed by the addition of potassium hexacyanoruthenate(II), potassium (5-methylthiazole)-pentachloroiridate, a small amount of KI solution, and shelling without any dopant. The resultant emulsion contains cubic-shaped grains having edge length of 0.6 $\mu$m. The emulsion is optimally sensitized by the addition of a colloidal suspension of aurous sulfide and heat ramped to 60° C., during which time blue sensitizing dye BSD-4, potassium hexchloroiiidate, Lippmann bromide, and 1-(3-acetamidophenyl)-5-mercaptotetrazole were added.

EB-2: To a reactor incorporating a stirring device as disclosed in Research Disclosure, Item 38213, and containing 8.756 kg of distilled water, 25 mg of p-glutaramidophenyl disulfide and 251 g of bone gelatin were added to 291 g of 3.8 M sodium chloride salt solution such that the mixture was maintained at a pCl of about 1.05 at approximately 68° C. To this were added 1.9 of 1,8-dihydroxy-3,6-dithiaoctane approximately 30 seconds before commencing introduction of silver and chloride salt solutions. Aqueous solutions of about 3.7 M silver nitrate and about 3.8 M sodium chloride were then added by conventional controlled double-jet addition at a constant silver nitrate flow rate of about 74 mL/min for about 39 min.

while maintaining pCl constant at about 1.05. Both the silver and sodium salt solution pumps were then turned off, and about 0.8 M potassium iodide solution was added to the stirred reaction mixture over about 30 seconds at a constant flow rate of about 62.9 mL/min. The resultant iodochloride emulsion was then grown further by conventional controlled double-jet addition for about 4.5 min. by resumed addition of silver and sodium salt solutions at about 74 mL/min. at a pCl of about 1.05. In addition, cesium pentachloronitrosylosmate was added at approximately 4 to 70% into the precipitation, potassium hexacyanoruthenate at 75 to 80%, and iridium pentachloro-5-methylthiazole was added at 95 to 98% band after iodide addition. A silver iodochloride emulsion was thus prepared with 0.2 mole % iodide located at 90% of total grain volume. Cubic edge length was 0.64 micron.

A portion of this silver iodochloride emulsion was optimally sensitized by the addition of p-glutaramidophenyl disulfide followed by the addition of a colloidal suspension of aurous sulfide and heat ramped to 60° C., during which time blue sensitizing dye (BSD-1), potassium hexachloroiridate, Lippmann bromide, and 1-(3-acetamidophenyl)-5-mercaptotetrazole were added.

Green Sensitive Emulsion

EG-1: A high chloride silver halide emulsion is precipitated by adding approximately equimolar silver nitrate and sodium chloride solutions into a well-stirred reactor containing gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic-shaped grains of 0.3 μm in edge length size. The emulsion is optimally sensitized by the addition of glutaryldiaminophenyldisulfide, a colloidal suspension of aurous sulfide and heat ramped to 55° C., during which time potassium hexachloroiridate doped Lippmann bromide, a liquid crystalline suspension of green sensitizing dye GSD-1, and 1-(3-acetamidophenyl)-5-mercaptotetrazole were added.

EG-2: A reaction vessel contained 5.0 L of a solution that was 6.9% in regular gelatin and contained 1.80 g of a Pluronicm antifoam agent. To this stirred solution at 58° C., 74.4 g of 2.8 M NaCl was dumped. A half min. after addition of NaCl solution, 70 mL of a 2.6 M AgNO3 solution, and 77.6 mL of 2.8 M NaCl were added simultaneously at 35 mL/min. The vAg set point was chosen equal to that observed in the reactor at this time. The 2.6 M silver nitrate solution and the 2.8 M sodium chloride solution were added simultaneously with a ramped linearly increasing flow from 35 mL/min. to 123 mL/min. over 18 min. To this, 2.6 M silver nitrate solution and the 2.8 M sodium chloride solution were added simultaneously with a constant flow at 123 mL/min. over 23.7 min. During precipitation, 1.6 micrograms per silver mole of cesium pentachloronitrosylosmate (Cs2(II)Os[NO]C15) was added during to 3.5 to 70% of grain formation, and 0.52 milligrams per silver mole of K2IrC15 (5-methylthiazole) was added during to 90 to 95% of grain formation. The resulting silver chloride emulsion had a cubic shape that was 0.35 μm in edge length. The emulsion was then washed using an ultrafiltration unit, and its final pH and pCl were adjusted to 5.6 and 1.8, respectively.

A portion of this silver chloride emulsion was optimally sensitized by the addition of green sensitizing dye GSD-1, followed by the addition of a colloidal suspension of aurous sulfide and heat ramped to 60° C., and then held for 34 min. After cooling emulsion to 40° C. 1-(3-acetamidophenyl)-5-mercaptotetrazole, potassium bromide and potassium chloride were added.

Red Sensitive Emulsion

ER-1: A high chloride silver halide emulsion is precipitated by adding approximately equimolar silver nitrate and sodium chloride solutions into a well-stirred reactor containing gelatin peptizer and thioether ripener. During the silver halide grain formation, potassium hexacyanoruthenate (II) and potassium (5-methylthiazole)-pentachloroiridate are added. The resultant emulsion contains cubic shaped grains of 0.4 μm in edge length size. The emulsion is optimally sensitized by the addition of glutaryldiaminophenyldisulfide, sodium thiosulfate, tripotassium bis{2-[3-(2-sulfobenzamido)phenyl]-mercaptotetrazole} gold(I) and heat ramped to 64° C., during which time 1-(3-acetamidophenyl)-5-mercaptotetrazole, potassium hexachloroiridate, and potassium bromide are added. The emulsion is then cooled to 40° C., pH adjusted to 6.0, and red sensitizing dye RSD-1 is added.

ER-2: A reaction vessel contained 6.92 L of a solution that was 3.8% in regular gelatin and contained 1.71 g of a PluronicTm antifoam agent. To this stirred solution at 46° C., 83.5 mL of 3.0 M NaCl was dumped, and soon after 28.3 mL of dithiaoctanediol solution was poured into the reactor. A half min. after addition of dithiaoctanediol solution, 104.5 mL of a 2.8 M AgNO3 solution and 107.5 mL of 3.0 M NaCl were added simultaneously at 209 mL/min. for 0.5 min. The vAg set point was chosen equal to that observed in the reactor at this time. Then the 2.8 M silver nitrate solution and the 3.0 M sodium chloride solution were added simultaneously with a constant flow at 209 mL/min. over 20.75 min. During precipitation, 1.5 micrograms per silver mole of cesium pentachloronitrosylosmate (Cs2(II)Os[NO]C15) was added during to 3.5 to 70% of grain formation, and 2.20 milligrams per silver mole of K2IrC15 (5-methylthiazole) was added during to 90 to 95% of grain formation. The resulting silver chloride emulsion had a cubic shape that was 0.38 μm in edge length. The emulsion was then washed using an ultrafiltration unit, and its final pH and pCl were adjusted to 5.6 and 1.8, respectively.

A portion of this silver chloride emulsion was optimally sensitized by the addition of p-glutaramidophenyl disulfide followed by the addition of a sulfide and gold(I). Emulsion was then heat ramped to 65° C., during which time potassium hexachloroiridate, potassium bromide, and 1-(3-acetamidophenyl)-5-mercaptotetrazole were added. Emulsion was then cooled down to 40° C., and red sensitizing dye RSD-1 was added.

BSD-1

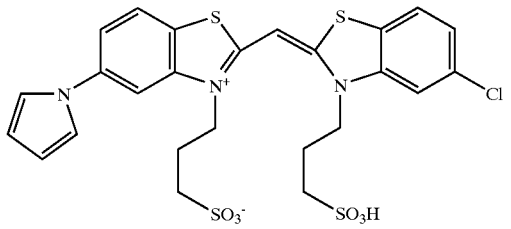

-continued

GSD-1

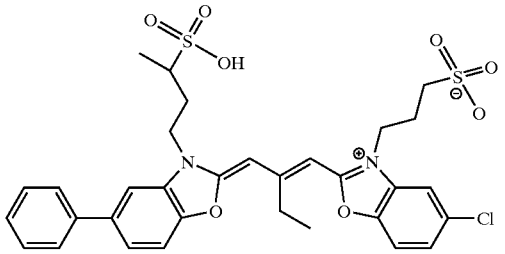

RSD-1

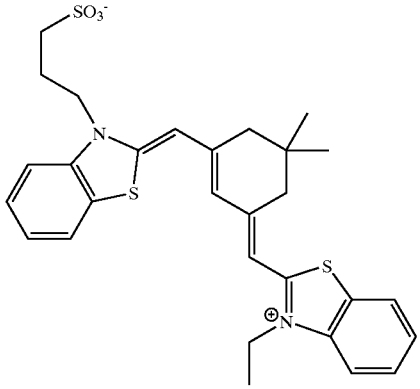

Coupler dispersions were emulsified by methods well known to the art. The following optimized light sensitive silver halide imaging layers are utilized to prepare a photographic label utilizing the invention label base material. They are prepared by methods well known to the art, and coated utilizing a curtain coating process. Structures for all of the numbered components are shown below and in the detailed description of the invention.

| Layer | Item | Laydown ($g/m^2$) |
|---|---|---|
| OC-1 | Overcoat e8 | |
| | Gelatin | 0.6456 |
| | Ludox AM ™ (colloidal silica) | 0.1614 |
| | Polydimethylsiloxane (DC200 ™) | 0.0202 |
| | 5-chloro-2-methyl-4-isothiazolin-3-one/2-methyl-4-isothiazolin-3-one (3/1) | 0.0001 |
| | SF-1 | 0.0081 |
| | SF-2 | 0.0032 |
| | Tergitol 15-S-5 ™ (surfactant) | 0.0020 |
| | Aerosol OT ™ (surfactant) | 0.0029 |
| OC-2 | Overcoat e8-uv layer | |
| | Gelatin | 0.6456 |
| | Ludox AM ™ (colloidal silica) | 0.1614 |
| | Polydimethylsiloxane (DC200 ™) | 0.0202 |
| | 5-chloro-2-methyl-4-isothiazolin-3-one/2-methyl-4-isothiazolin-3-one (3/1) | 0.0001 |
| | SF-1 | 0.0081 |
| | SF-2 | 0.0032 |
| | Tergitol 15-S-5 ™ (surfactant) | 0.0020 |
| | Aerosol OT ™ (surfactant) | 0.0029 |
| | 2,5-Di-tert-octyl hydroquinone | 0.0655 |
| OC-3 | Overcoat d3 | |
| | Gelatin | 1.076 |
| | 2,5-Di-tert-octyl hydroquinone | 0.013 |
| | Dibutyl phthalate | 0.039 |
| | SF-1 | 0.009 |
| | SF-2 | 0.004 |
| | Polystyrene Matte Beads (2.5 micron average diameter) | 0.013 |
| OC-4 | Overcoat d3 w/o uv layer | |
| | Gelatin | 1.076 |
| | 2,5-Di-tert-octyl hydroquinone | 0.055 |
| | Dibutyl phthalate | 0.117 |
| | SF-1 | 0.009 |
| | SF-2 | 0.004 |
| | Polystyrene Matte Beads (2.5 micron average diameter) | 0.013 |
| UV-1 | UV Layer e8 | |
| | Gelatin | 0.8231 |
| | UV-1 | 0.0355 |
| | UV-2 | 0.2034 |
| | 2,5-Di-tert-octyl hydroquinone | 0.0655 |
| | SF-1 | 0.0125 |
| | S-6 | 0.0797 |
| | 5-chloro-2-methyl-4-isothiazolin-3-one/2-methyl-4-isothiazolin-3-one (3/1) | 0.0001 |
| UV-2 | UV Layer e8-uv | |
| | Gelatin | 0.8231 |
| | 2,5-Di-tert-octyl hydroquinone | 0.0655 |
| | SF-1 | 0.0125 |
| | S-6 | 0.0797 |
| | 5-chloro-2-methyl-4-isothiazolin-3-one/2-methyl-4-isothiazolin-3-one (3/1) | 0.0001 |
| UV-3 | UV Layer d3 | |
| | Gelatin | 0.537 |
| | UV-1 | 0.023 |
| | UV-2 | 0.130 |
| | 2,5-Di-tert-octyl hydroquinone | 0.042 |
| | Dibutyl phthalate | 0.025 |
| | 1,4-Cyclohexylenedimethylene bis(2-ethylhexanoate) | 0.025 |
| UV-4 | UV Layer d3 - uv | |
| | Gelatin | 0.537 |
| | 2,5-Di-tert-octyl hydroquinone | 0.042 |
| | Dibutyl phthalate | 0.025 |
| | 1,4-Cyclohexylenedimethylene bis(2-ethylhexanoate) | 0.025 |
| RL-1 | Red Sensitive Layer e8 | |
| | Gelatin | 1.3558 |
| | Red Sensitive silver ER-1 | 0.1883 |
| | C-35 | 0.2324 |
| | C-36 | 0.0258 |
| | UV-2 | 0.3551 |
| | Dibutyl sebacate | 0.4358 |
| | S-6 | 0.1453 |
| | DYE-3 | 0.0229 |
| | Potassium p-toluenethiosulfonate | 0.0026 |
| | 5-chloro-2-methyl-4-isothiazolin-3-one/2-methyl-4-isothiazolin-3-one (3/1) | 0.0001 |
| | Sodium Phenylmercaptotetrazole | 0.0005 |
| | SF-1 | 0.0524 |
| RL-2 | Red Sensitive Layer e8-uv | |
| | Gelatin | 1.3558 |
| | Red Sensitive silver ER-1 | 0.1883 |
| | C-35 | 0.2324 |
| | C-36 | 0.0258 |
| | Dibutyl sebacate | 0.4358 |
| | S-6 | 0.1453 |
| | DYE-3 | 0.0229 |
| | Potassium p-toluenethiosulfonate | 0.0026 |
| | 5-chloro-2-methyl-4-isothiazolin-3-one/2-methyl-4-isothiazolin-3-one (3/1) | 0.0001 |
| | Sodium Phenylmercaptotetrazole | 0.0005 |
| | SF-1 | 0.0524 |

-continued

| Layer | Item | Laydown (g/m²) |
|---|---|---|
| RL-3 | Red Sensitive Layer d3 | |
| | Gelatin | 1.211 |
| | Red Sensitive silver ER-2 | 0.200 |
| | C-41 | 0.400 |
| | Dibutyl phthalate | 0.392 |
| | UV-2 | 0.259 |
| | 2-(2-butoxyethoxy)ethyl acetate | 0.033 |
| | 2,5-Di-tert-octyl hydroquinone | 0.003 |
| | Potassium tolylthiosulfonate (TSS) | 0.001 |
| | Potassium tolylsulfinate (TS) | 0.0001 |
| | DYE-3 | 0.021 |
| RL-4 | Red Sensitive Layer d3-uv | |
| | Gelatin | 1.211 |
| | Red Sensitive silver ER-2 | 0.200 |
| | C-41 | 0.400 |
| | Dibutyl phthalate | 0.392 |
| | 2-(2-butoxyethoxy)ethyl acetate | 0.033 |
| | 2,5-Di-tert-octyl hydroquinone | 0.003 |
| | Potassium tolylthiosulfonate | 0.001 |
| | Potassium tolylsulfinate | 0.0001 |
| | DYE-3 | 0.021 |
| RL-5 | Red Sensitive Layer e8-uv, d3 emulsion | |
| | Gelatin | 1.3558 |
| | Red Sensitive silver ER-2 | 0.1883 |
| | C-35 | 0.2324 |
| | C-36 | 0.0258 |
| | Dibutyl sebacate | 0.4358 |
| | S-6 | 0.1453 |
| | DYE-3 | 0.0229 |
| | Potassium p-toluenethiosulfonate | 0.0026 |
| | 5-chloro-2-methyl-4-isothiazolin-3-one/2-methyl-4-isothiazolin-3-one (3/1) | 0.0001 |
| | Sodium Phenylmercaptotetrazole | 0.0005 |
| | SF-1 | 0.0524 |
| ILa-1 | M/C Interlayer e8 | |
| | Gelatin | 0.7532 |
| | 2,5-Di-tert-octyl hydroquinone | 0.1076 |
| | S-3 | 0.1969 |
| | Acrylamide/t-Butylacrylamide sulfonate copolymer | 0.0541 |
| | Bis-vinylsulfonylmethane | 0.1390 |
| | 3,5-Dinitrobenzoic acid | 0.0001 |
| | Citric acid | 0.0007 |
| | Catechol disulfonate | 0.0323 |
| | 5-chloro-2-methyl-4-isothiazolin-3-one/2-methyl-4-isothiazolin-3-one (3/1) | 0.0001 |
| Ila-2 | M/C Interlayer d3 | |
| | Gelatin | 0.712 |
| | UV-1 | 0.030 |
| | UV-2 | 0.172 |
| | 2,5-Di-tert-octyl hydroquinone | 0.055 |
| | Dibutyl phthalate | 0.034 |
| | 1,4-Cyclohexylenedimethylene bis(2-ethylhexanoate) | 0.034 |
| Ila-3 | M/C Interlayer d3-uv | |
| | Gelatin | 0.712 |
| | 2,5-Di-tert-octyl hydroquinone | 0.055 |
| | Dibutyl phthalate | 0.034 |
| | 1,4-Cyclohexylenedimethylene bis(2-ethylhexanoate) | 0.034 |
| GL-1 | Green Sensitive Layer e8 | |
| | Gelatin | 1.1944 |
| | Green Sensitive Silver EG-1 | 0.1011 |
| | M-4 | 0.2077 |
| | Oleyl Alcohol | 0.2174 |
| | S-3 | 0.1119 |
| | ST-5 | 0.0398 |
| | ST-6 | 0.2841 |
| | DYE-2 | 0.0073 |

-continued

| Layer | Item | Laydown (g/m²) |
|---|---|---|
| | 5-chloro-2-methyl-4-isothiazolin-3-one/2-methyl-4-isothiazolin-3-one (3/1) | 0.0001 |
| | SF-1 | 0.0236 |
| | Potassium chloride | 0.0204 |
| | Sodium Phenylmercaptotetrazole | 0.0007 |
| GL-2 | Green Sensitive Layer e8-st | |
| | Gelatin | 1.1944 |
| | Green Sensitive Silver EG-1 | 0.1011 |
| | M-4 | 0.2077 |
| | Oleyl Alcohol | 0.2174 |
| | S-3 | 0.1119 |
| | DYE-2 | 0.0073 |
| | 5-chloro-2-methyl-4-isothiazolin-3-one/2-methyl-4-isothiazolin-3-one (3/1) | 0.0001 |
| | SF-1 | 0.0236 |
| | Potassium chloride | 0.0204 |
| | Sodium Phenylmercaptotetrazole | 0.0007 |
| GL-3 | Green Sensitive Layer d3 | |
| | Gelatin | 1.364 |
| | Green Sensitive Silver EG-2 | 0.113 |
| | M-1 | 0.214 |
| | DYE-2 | 0.009 |
| | Dibutyl phthalate | 0.076 |
| | ST-3 | 0.058 |
| | ST-5 | 0.163 |
| | ST-6 | 0.543 |
| GL-4 | Green Sensitive Layer d3-stab | |
| | Gelatin | 1.364 |
| | Green Sensitive Silver EG-2 | 0.113 |
| | M-1 | 0.214 |
| | DYE-2 | 0.009 |
| | Dibutyl phthalate | 0.076 |
| GL-5 | Green Sensitive Layer e8-st, d3 emulsion | |
| | Gelatin | 1.1944 |
| | Green Sensitive Silver EG-2 | 0.1011 |
| | M-4 | 0.2077 |
| | Oleyl Alcohol | 0.2174 |
| | S-3 | 0.1119 |
| | DYE-2 | 0.0073 |
| | 5-chloro-2-methyl-4-isothiazolin-3-one/2-methyl-4-isothiazolin-3-one (3/1) | 0.0001 |
| | SF-1 | 0.0236 |
| | Potassium chloride | 0.0204 |
| | Sodium Phenylmercaptotetrazole | 0.0007 |
| Ilb-1 | Interlayer e8 | |
| | Gelatin | 0.7532 |
| | 2,5-Di-tert-octyl hydroquinone | 0.1076 |
| | S-3 | 0.1969 |
| | 5-chloro-2-methyl-4-isothiazolin-3-one/2-methyl-4-isothiazolin-3-one (3/1) | 0.0001 |
| | Catechol disulfonate | 0.0323 |
| | SF-1 | 0.0081 |
| Ilb-2 | Interlayer d3 | |
| | Gelatin | 0.753 |
| | 2,5-Di-tert-octyl hydroquinone | 0.066 |
| | Dibutyl phthalate | 0.188 |
| | Disodium 4,5 Dihydroxy-m-benzenedisulfonate | 0.065 |
| | Irganox 1076 ™ | 0.010 |
| YC-1 | Yellow Coupler Layer d3 | |
| | Gelatin | 0.323 |
| | Y-5 | 0.194 |
| | ST-1 | 0.033 |
| | ST-2 | 0.011 |
| | Diundecyl phthalate | 0.085 |
| YC-2 | Yellow Coupler Layer d3-st | |
| | Gelatin | 0.323 |
| | Y-5 | 0.194 |

-continued

| Layer | Item | Laydown ($g/m^2$) |
|---|---|---|
| | Diundecyl phthalate | 0.085 |
| BL-1 | Blue Sensitive Layer e8 | |
| | Gelatin | 1.3127 |
| | Blue sensitive silver EB-1 | 0.2399 |
| | Y-4 | 0.4143 |
| | Tributyl Citrate | 0.2179 |
| | ST-4 | 0.0095 |
| | ST-7 | 0.4842 |
| | ST-8 | 0.1211 |
| | Sodium Phenylmercaptotetrazole | 0.0001 |
| | Piperidino hexose reductone | 0.0024 |
| | 5-chloro-2-methyl-4-isothiazolin-3-one/2-methyl-4-isothiazolin-3-one (3/1) | 0.0002 |
| | SF-1 | 0.0366 |
| | Potassium chloride | 0.0204 |
| | DYE-1 | 0.0148 |
| BL-2 | Blue Sensitive Layer e8-st | |
| | Gelatin | 1.3127 |
| | Blue sensitive silver EB-1 | 0.2399 |
| | Y-4 | 0.4143 |
| | Tributyl Citrate | 0.2179 |
| | Sodium Phenylmercaptotetrazole | 0.0001 |
| | Piperidino hexose reductone | 0.0024 |
| | 5-chloro-2-methyl-4-isothiazolin-3-one/2-methyl-4-isothiazolin-3-one (3/1) | 0.0002 |
| | SF-1 | 0.0366 |
| | Potassium chloride | 0.0204 |
| | DYE-1 | 0.0148 |
| BL-3 | Blue Sensitive Layer d3 | |
| | Gelatin | 1.246 |
| | Blue sensitive silver EB-2 | 0.280 |
| | Y-5 | 0.452 |
| | ST-1 | 0.078 |
| | ST-2 | 0.026 |
| | DYE-1 | 0.032 |
| | Diundecyl phthalate | 0.198 |
| BL-4 | Blue Sensitive Layer d3-stab | |
| | Gelatin | 1.246 |
| | Blue sensitive silver EB-2 | 0.280 |
| | Y-5 | 0.452 |
| | DYE-1 | 0.032 |
| | Diundecyl phthalate | 0.198 |
| BL-5 | Blue Sensitive Layer e8-st, d3 emulsion | |
| | Gelatin | 1.3127 |
| | Blue sensitive silver EB-1 | 0.2399 |
| | Y-4 | 0.4143 |
| | Tributyl Citrate | 0.2179 |
| | Sodium Phenylmercaptotetrazole | 0.0001 |
| | Piperidino hexose reductone | 0.0024 |
| | 5-chloro-2-methyl-4-isothiazolin-3-one/2-methyl-4-isothiazolin-3-one (3/1) | 0.0002 |
| | SF-1 | 0.0366 |
| | Potassium chloride | 0.0204 |
| | DYE-1 | 0.0148 |

Additional Structures

DYE-1

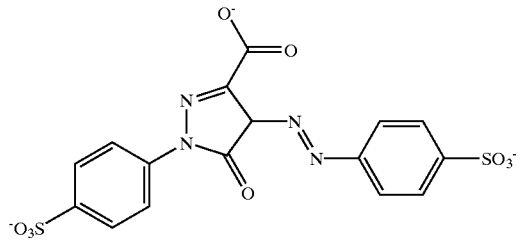

DYE-2

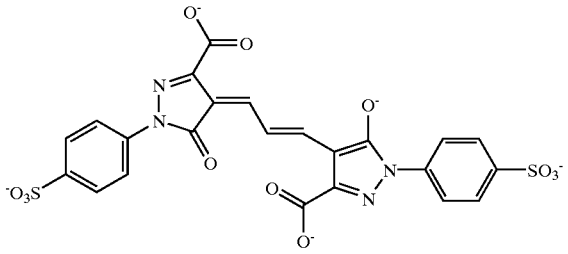

DYE-3

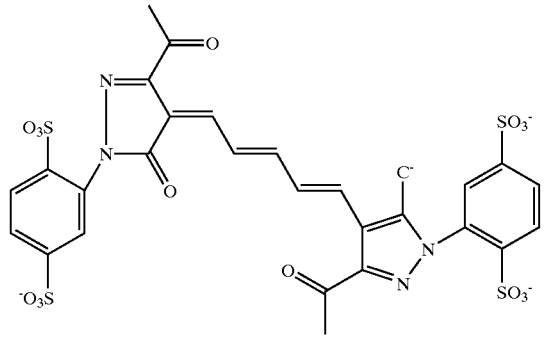

ST-1

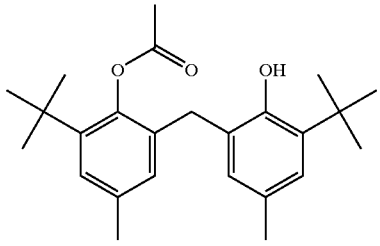

ST-2

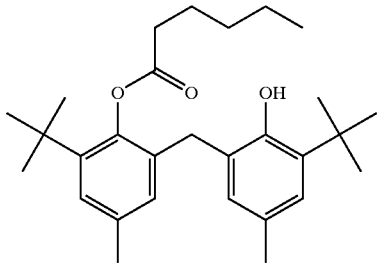

-continued

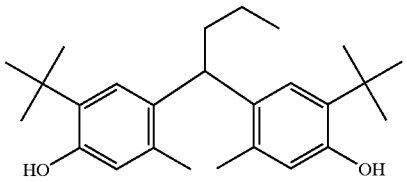

ST-3

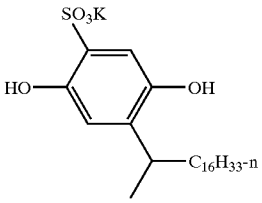

ST-4

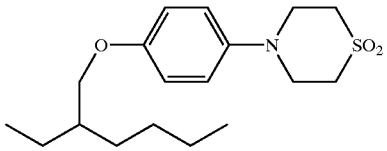

ST-5

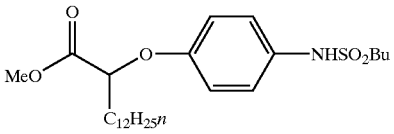

ST-6

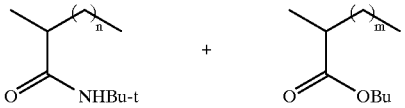

n:m 1:1 mw = 75-100,000

ST-7

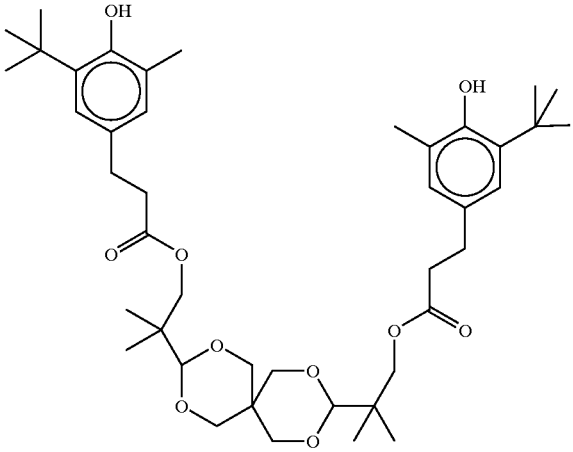

ST-8

The light-sensitive silver halide emulsion coated on the label support of this example can be printed using digital photographic printers. The printed images are then developed using standard reflective photographic RA4 wet chemistry. At this point, the image is formed on a thin label support. To further improve the durability of the developed image layers, an environmental protection layer can then be applied to the topmost gelatin layer in the imaging layers.

The environmental protection layer can be prepared using 7.5 $\mu$m ground polymer particles (styrene butyl acrylate available from Hercules as Piccotoner 1221), a soft latex binder (copolymer of butyl acrylate, 2-acrylamido-2-methylpropanesulfonate, and acetoacetoxyethylmethacrylate) as a 20% suspension, a hydrophilic thickening agent (Keltrol T) as a 1% solution, and a surfactant (O1in 10G) as a 10% solution.

An alternative environmental protection layer can in the form of a preformed laminated sheet or roll, which can be applied to the topmost gelatin layer after photo processing.

The entire structure of the imaged, protected silver halide pressure sensitive packaging label follows:

| |
|---|
| Environmental Protection Layer |
| Imaging Layers |
| Pragmatic Sheet |
| Pressure Sensitive Adhesive and Release System |
| Carrier Sheet |

One can treat this entire label structure as a system of subsystems. Each subsystem is comprised of multiple component layers. Each subsystem can be optimized in accordance with this invention. The Imaging Layer and Pragmatic Sheet subsystems are detailed in Tables 1 and 2, with the inventive component layer combinations indicated. Particularly advantageous combinations of subsystems of the invention are listed in Table 3.

TABLE 1

| | Sub System 1, Imaging Layers | | | | | |
|---|---|---|---|---|---|---|
| Variation | SS1-1 | SS1-2 | SS1-3 | SS1-4 | SS1-5 | SS1-6 |
| Component | Comparison | Invention | Invention | Invention | Invention | Invention |
| Overcoat | OC-1 | OC-1 | OC-1 | OC-2 | OC-2 | OC-2 |
| UV Layer | UV-1 | UV-1 | UV-2 | omit | omit | omit |
| Red Layer | RL-1 | RL-1 | RL-2 | RL-2 | RL-5 | RL-5 |

TABLE 1-continued

| | | | | | | |
|---|---|---|---|---|---|---|
| Interlayer | ILa-1 | ILa-1 | ILa-1 | ILa-1 | ILa-1 | ILa-1 |
| Green Layer | GL-1 | GL-2 | GL-2 | GL-2 | GL-5 | GL-5 |
| Interlayer | ILb-1 | ILb-1 | ILb-1 | ILb-1 | ILb-1 | ILb-1 |
| Yellow Coupler Layer | omit | omit | omit | omit | omit | YC-2 |
| Blue Layer | BL-1 | BL-2 | BL-2 | BL-2 | BL-5 | BL-4 |

| Variation | SS1-7 | SS1-8 | SS1-9 | SS1-10 |
|---|---|---|---|---|
| Component | Comparison | Invention | Invention | Invention |
| Overcoat | OC-3 | OC-3 | OC-3 | OC-4 |
| UV Layer | UV-3 | UV-3 | UV-4 | omit |
| Red Layer | RL-3 | RL-3 | RL-4 | RL-4 |
| Interlayer | ILa-2 | ILa-2 | ILa-3 | ILa-3 |
| Green Layer | GL-3 | GL-4 | GL-4 | GL-4 |
| Interlayer | ILb-2 | ILb-2 | ILb-2 | ILb-2 |
| Yellow Coupler Layer | YC-1 | YC-2 | YC-2 | YC-2 |
| Blue Layer | BL-3 | BL-4 | BL-4 | BL-4 |

Descriptions
SS1-1: e8
SS1-2: e8-stab
SS1-3: e8-stab, -all uv
SS1-4: e8-stab, -all uv, omit uv layer
SS1-5: e8-stab, -all uv, omit uv layer, d3 emulsions
SS1-6: e8-stab, -all uv, omit uv layer, d3 emulsions, d3 yellow coupler/blue layer
SS1-7: d3
SS1-8: d3-stab
SS1-9: d3-stab, -all uv
SS1-10: d3-stab, -all uv, omit uv layer

TABLE 2

Sub System 2, Pragmatic Sheet

| Variation | SS2-1 |
|---|---|
| Component | Invention |
| Pragmatic Layer A | PLA-1 |
| Pragmatic Layer B | PLB-1 |
| Pragmatic Layer C | PLC-1 |
| Pragmatic Layer D | PLD-1 |
| Pragmatic Layer E | PLB-1 |

Descriptions
SS2-1:
SS2-2:
SS2-3:

TABLE 3

| Variation | S-1 | S-2 | S-3 |
|---|---|---|---|
| Subsystem | Invention | Invention | Invention |
| Imaging Layer | SS1-6 | SS1-6 | SS1-6 |
| Pragmatic Layer | SS2-1 | SS2-2 | SS2-3 |

| Variation | S-4 | S-5 |
|---|---|---|
| Subsystem | Invention | Invention |
| Imaging Layer | | |
| Pragmatic Layer | | |

Descriptions
S-1: Optimal imaging layers, Proto 3 facestock,

The biaxially oriented polyolefin pragmatic sheet from above additonally contained 12% by weight a 0.25 micrometer rutile $TiO_2$ in the 4 micrometer polyolefin layer adjacent the blue tinted polyethylene layer. The stiffness of the pragmatic sheet was 12 millinewtons for high speed label dispensing. The thickness of the pragmatic sheet was 70 micrometers.

S-2: Optimal imaging layers, Proto 3+hi $TiO_2$ facestock, The biaxially oriented polyolefin pragmatic sheet from above additionally contained 28% by weight a 0.25 micrometer rutile $TiO_2$ in the 4 micrometer polyolefin layer adjacent the blue tinted polyethylene layer. The stiffniess of the pragmatic sheet was 14 millinewtons for high speed label dispensing and was 72 micrometers thick.

S-3: Optimal imaging layers, Duralife facestock,

The biaxially oriented polyolefin pragmatic sheet from above additionally contained 24% by weight a 0.22 micrometer anatase $TiO_2$ in the 8 micrometer polyolefin layer adjacent the blue tinted polyethylene layer. The stiffness of the pragmatic sheet was 7 milinewtons and was 35 micrometers thick. This pragmatic sheet can be hand applied or when overlaminated with a 25 micrometer oriented clear polymer sheet can be high speed dispensed.

The photographic packaging label of the invention has significant advantages. The invention provides all of the advantages of a digital silver halide label printing system. The use of a customized light sensitive layer formulation delivers dye stability, color gamut, and curl propensity appropriate for the product use, all at minimized cost.

The invention has been described in detail with particular reference to certain preferred embodiments thereof, but it will be understood that variations and modifications can be effected within the spirit and scope of the invention.

What is claimed is:

1. A photographic label comprising a pragmatic polymer sheet, at least one layer comprising at least one image forming layer comprising photosensitive silver halide grains and dye forming coupler above said pragmatic polymer sheet, wherein said at least one image forming layer has an exposure time to obtain a usable Dmax of 1.5 of less than 0.01 seconds, wherein said at least one image forming layer is substantially free of image dye stabilizers, and wherein said polymer sheet has an L* of greater than 95.

2. The photographic label of claim 1 wherein said label comprises a total silver content of greater than 4.6 milligrams per square meter.

3. The photographic label of claim 1 wherein said photosensitive silver halide grains are doped with at least one member selected from the group consisting of Fe, Co, Ni, Ru, Rh, Pd, Os, Re, and Ir.

4. The photographic label of claim 1 wherein said photosensitive silver halide grains are doped with at least one member selected from the group consisting of Os, Re, and Ir.

5. The photographic label of claim 1 wherein said silver halide grains comprise a combination of Re and Ir dopants.

6. The photographic label of claim 1 wherein said photographic label is substantially free of ultraviolet absorbers.

7. The photographic label of claim 1 wherein said label is substantially free of blue pigment.

8. The photographic label of claim 1 wherein said at least one image forming layer comprises blue pigment with a particle size of less than 0.1 micrometers.

9. The photographic label of claim 1 wherein said at least one image forming layer comprises blue pigment with a particle size of between 0.001 and 0.12 micrometers.

10. The photographic label of claim 1 further comprising at least one subbing layer between said pragmatic sheet and said at least one image forming layer.

11. The photographic label of claim 1 wherein said polymer sheet comprises an upper emulsion adhesive layer comprising polyethylene.

12. The photographic label of claim 1 wherein said polymer sheet comprises titanium dioxide in a layer immediately below the upper surface.

13. The photographic label of claim 12 wherein said titanium dioxide comprises between 18 and 50% by weight of said polymer layer comprising titanium dioxide.

14. The photographic label of claim 1 wherein said polymer sheet comprises voids in a layer thickness of 35 to 75 micrometers.

15. The photographic label of claim 1 wherein said polymer sheet has a stiffness of between 8 and 24 millinewtons.

16. The photographic label of claim 1 wherein the gelatin containing layers have a stiffness between 1 and 4 millinewtons.

17. The photographic label of claim 1 wherein said label has a stiffness of between 8 and 20 millinewtons.

18. The photographic label of claim 1 wherein said polymer sheet comprises polyester.

19. The photographic label of claim 18 wherein said polymer sheet comprises at least one layer having titanium dioxide present in an amount of between 24 and 50% by weight.

20. The photographic label of claim 1 wherein said photographic label has a barcode quality when developed of between "A" and "B" level.

21. The photographic label of claim 1 wherein said label has a gelatin content of between 45 and 55 grams per $m^2$.

22. The photographic label of claim 6 wherein said label has a gelatin content of between 40 and 50 grams per $m^2$.

23. The photographic label of claim 1 wherein said label comprises an image forming layer comprising at least one cyan dye forming couplers comprising

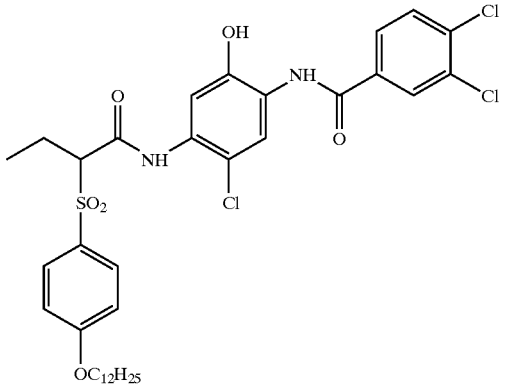

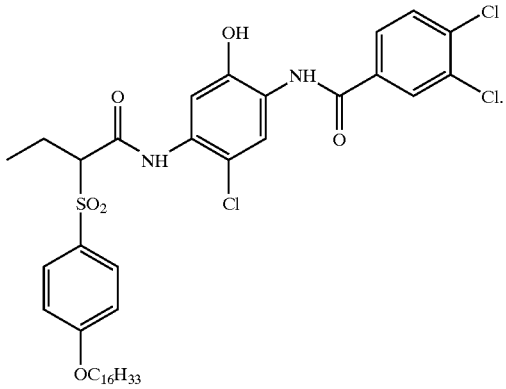

24. The photographic label of claim 23 wherein said label comprises an image forming layer comprising a magenta dye forming coupler comprising

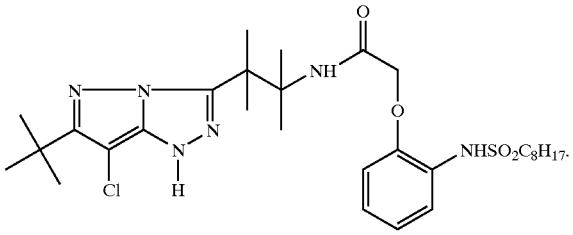

25. The photographic label of claim 24 wherein said label comprises an image forming layer comprising a yellow dye forming coupler comprising

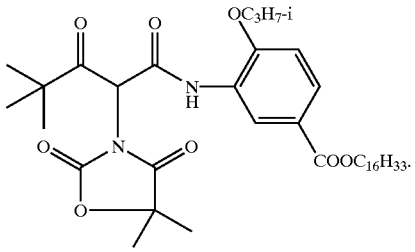

26. The photographic label of claim 23 wherein said label comprises an image forming layer comprising a magenta dye forming coupler comprising

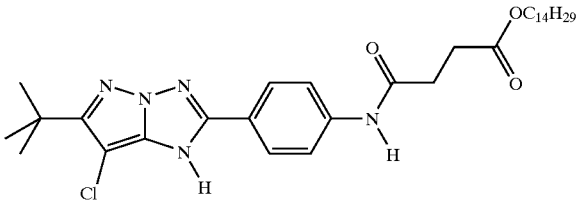

and an image forming layer comprising a yellow dye forming coupler comprising

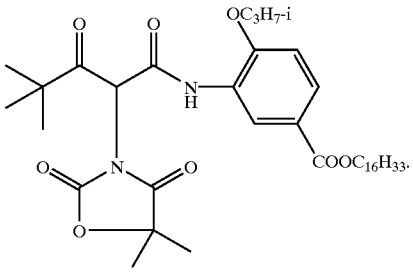

27. The photographic label of claim 1 further comprising a fourth additional light sensitive silver halide imaging layer having associated therewith an image dye-forming coupler for which the normalized spectral transmission density distribution curve of the dye formed by said image dye-forming coupler upon reaction with color developer has a CIELAB hue angle, $h_{ab}$, from 225 to 310° or from not less than 355 to not more than 75°.

28. The photographic label of claim 1 further comprising a fourth light sensitive silver halide imaging layer having associated therewith a fourth image dye-forming coupler for which the normalized spectral transmission density distribution curve of the dye formed by the fourth image dye-forming coupler upon reaction with color developer has a CIELAB hue angle, $h_{ab}$, from 225 to 310°, and a fifth light sensitive silver halide imaging layer having associated therewith a fifth image dye-forming coupler for which the normalized spectral transmission density distribution curve of the dye formed by the fifth image dye-forming coupler upon reaction with color developer has a CIELAB hue angle, $h_{ab}$, from not less than 355 to not more than 75°.

29. The photographic label of claim 1 wherein said silver halide grains comprise a radiation-sensitive emulsion comprised of silver halide grains (a) containing greater than 50 mole percent chloride, based on silver, (b) having greater than 50 percent of their surface area provided by {100} crystal faces, and (c) having a central portion accounting for up to 99 percent of total silver and containing a first dopant of Formula (I) and a second dopant of Formula (II):

$$[ML_6]^n \quad (I)$$

wherein n is zero, −1, −2, −3 or −4,

M is a filled frontier orbital polyvalent metal ion, other than iridium, and $L_6$ represents bridging ligands which can be independently selected, provided that at least four of the ligands are anionic ligands, and at least one of the ligands is a cyano ligand or a ligand more electronegative than a cyano ligand;

$$[TE_4(NZ)E']^r \quad (II)$$

wherein T is Os or Ru, $E_4$ represents bridging ligands which can be independently selected, E' is E or NZ, r is zero, −1, −2 or −3, and Z is oxygen or sulfur, wherein the silver halide grains have an average equivalent spherical diameter of less than 0.9 micrometer, the dopant of Formula (II) is located within an inner core of the grains comprising up to 60 percent of the total silver, and the dopant of Formula (I) is located in an outer dopant band which is separated from the inner core by at least 10 percent of the total silver.

30. The photographic label of claim 1 wherein said silver halide grains comprise at least one radiation-sensitive silver halide emulsion layer icomprising silver halide grains containing greater than 50 mole percent chloride, based on silver, and having greater than 50 percent of their surface area provided by {100} crystal faces, wherein (i) a first fraction which comprises from 10–90 wt % of the silver halide grains, based on total radiation-sensitive silver halide in the layer, consists of grains which have a central portion accounting for up to 99 percent of total silver which contains at least $10^{-7}$ mole of a hexacoordination metal complex which satisfies formula (I) per mole of silver and less than $10^{-10}$ mole of a hexacoordination metal complex which satisfies formula (II) per mole of silver, and (ii) a second fraction which comprises from 10–90 wt % of the silver halide grains, based on total radiation-sensitive silver halide in the layer, consists of grains which have a central portion accounting for up to 99 percent of total silver which contains at least $10^{-10}$ mole of a hexacoordination metal complex which satisfies the formula (II) per mole of silver and less than $10^{-7}$ mole of a hexacoordination metal complex which satisfies the formula (I) per mole of silver:

$$[ML_6]^n \quad (I)$$

wherein n is zero, −1, −2, −3 or −4,

M is a filled frontier orbital polyvalent metal ion, other than iridium, and $L_6$ represents bridging ligands which can be independently selected, provided that at least four of the ligands are anionic ligands, and at least one of the ligands is a cyano ligand or a ligand more electronegative than a cyano ligand;

$$[TE_4(NZ)E']^r \quad (II)$$

where T is a Os or Ru;

$E_4$ represents bridging ligands which can be independently selected;

E' is E or NZ;

r is zero, −1, −2 or −3; and

Z is oxygen or sulfur.

31. The photographic label of claim 1 wherein said silver halide grains comprise a radiation-sensitive emulsion comprised of silver halide grains (a) containing greater than 50 mole percent chloride, based on silver, (b) having greater than 50 percent of their surface area provided by {100} crystal faces, and (c) having a central portion accounting for up to 99 percent of total silver and containing a first dopant of Formula (I):

$$[ML_6]^n \quad (I)$$

wherein n is zero, −1, −2, −3 or −4,

M is a filled frontier orbital polyvalent metal ion, other than iridium, and $L_6$ represents bridging ligands which can be independently selected, provided that at least four of the ligands are anionic ligands, and at least one of the ligands is a cyano ligand or a ligand more electronegative than a cyano ligand, wherein a second dopant comprising an iridium coordination complex having ligands each of which are more electropositive than a cyano ligand is located together with the first dopant in a common dopant band within the central portion of the silver halide grains.

* * * * *